US007014294B2

(12) United States Patent
Sakaida et al.

(10) Patent No.: US 7,014,294 B2
(45) Date of Patent: Mar. 21, 2006

(54) INK-JET HEAD AND INK-JET PRINTER HAVING INK-JET HEAD

(75) Inventors: Atsuo Sakaida, Gifu (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 71 days.

(21) Appl. No.: 10/367,714

(22) Filed: Feb. 19, 2003

(65) Prior Publication Data

US 2004/0090498 A1 May 13, 2004

Related U.S. Application Data

(63) Continuation-in-part of application No. 10/305,979, filed on Nov. 29, 2002, and a continuation-in-part of application No. 09/995,756, filed on Nov. 29, 2001, now Pat. No. 6,808,254.

(30) Foreign Application Priority Data

| | | |
|---|---|---|
| Nov. 30, 2000 | (JP) | 2000-365067 |
| Mar. 29, 2001 | (JP) | 2001-096421 |
| Nov. 30, 2001 | (JP) | 2001-365497 |
| Feb. 18, 2002 | (JP) | 2002-040524 |
| Feb. 21, 2002 | (JP) | 2002-044626 |
| Feb. 21, 2002 | (JP) | 2002-044650 |
| Feb. 21, 2002 | (JP) | 2002-045146 |

(51) Int. Cl.
*B41J 2/145* (2006.01)
*B41J 2/15* (2006.01)

(52) U.S. Cl. ..... 347/40

(58) Field of Classification Search ..... 347/40, 347/65, 68, 70

See application file for complete search history.

(56) References Cited

U.S. PATENT DOCUMENTS

| | | | |
|---|---|---|---|
| 4,317,124 | A | 2/1982 | Shirato et al. |
| 4,680,595 | A | 7/1987 | Cruz-Uribe et al. |
| 4,730,197 | A | 3/1988 | Raman et al. |
| 5,087,930 | A | 2/1992 | Roy et al. |
| 5,402,159 | A | 3/1995 | Takahashi et al. |
| 5,406,318 | A | 4/1995 | Moore et al. |
| 5,757,400 | A | 5/1998 | Hoisington |
| 2001/0020968 | A1 | 9/2001 | Isono et al. |

FOREIGN PATENT DOCUMENTS

| | | | |
|---|---|---|---|
| CN | 1314247 | A | 9/2001 |
| EP | 0 577 383 | A2 | 1/1994 |
| EP | 1 138 493 | A1 | 10/2001 |

(Continued)

*Primary Examiner*—Thinh Nguyen
(74) *Attorney, Agent, or Firm*—Oliff & Berridge, PLC

(57) ABSTRACT

An ink-jet head has a passage unit including a plurality of pressure chambers each having one end connected with a nozzle and another end connected with an ink supply source. Each of the pressure chambers is confined in each of a plurality of parallelogram regions and has an elliptical planar shape with no corner bulging in a direction to leave a line joining the one end and the another end in each of the pressure chambers, in a plane of the passage unit where the pressure chambers are arranged. The planar shape of the pressure chamber is slender along a longer diagonal line of a rhombic region, and a direction of the longer diagonal line of a rhombic region and a direction of a direction joining the one end and the other end in each of the pressure chambers are substantially coincident with each other.

30 Claims, 12 Drawing Sheets

FOREIGN PATENT DOCUMENTS

| | | |
|---|---|---|
| JP | 62-111758 | 5/1987 |
| JP | 2-4429 | 1/1990 |
| JP | 3-114654 | 5/1991 |
| JP | 4-341852 | 11/1992 |
| JP | 59-229115 | 9/1993 |
| JP | 5-338149 | 12/1993 |
| JP | 6-226975 | 8/1994 |
| JP | 7-67803 | 7/1995 |
| JP | 8-25628 | 1/1996 |
| JP | 8-267743 | 10/1996 |
| JP | 10-508808 | 9/1998 |
| JP | A 10-508808 | 9/1998 |
| JP | 2001-334661 | 12/2001 |

INK-JET HEAD AND INK-JET PRINTER HAVING INK-JET HEAD

CROSS-REFERENCE TO RELATED APPLICATION

This application is a continuation-in-part of application Ser. No. 09/995,756 filed on Nov. 29, 2001 now U.S. Pat. No. 6,808,254 and application Ser. No. 10/305,979, filed on Nov. 29, 2002, the disclosures of which are incorporated herein in their entireties by reference.

BACKGROUND OF THE INVENTION

1. Field of Invention

The invention relates to an ink-jet head for printing by ejecting ink onto a record medium, and to an ink-jet printer having the ink-jet head.

2. Description of Related Art

In an ink-jet printer, an ink-jet head distributes ink, which is supplied from an ink tank, to pulse pressure chambers. The ink-jet head selectively applies pulse pressure to each pressure chamber to eject ink through a nozzle connected with each pressure chamber. As a means for selectively applying pulse pressure to the pressure chambers, an actuator unit or the like may be used in which ceramic piezoelectric sheets are laminated. The printing operations are carried out while reciprocating such a head at a high speed in the widthwise direction of the paper.

As for the arrangement of the pressure chambers in such an ink-jet head, there is a one-dimensional arrangement in which pressure chambers are arranged in, e.g., one or two rows along the length of the head, and a two-dimensional arrangement in which pressure chambers are arranged in a matrix along a surface of the head. To achieve high-resolution and high-speed printing, the two-dimensional arrangement of pressure chambers is more effective. As an example of ink-jet head in which pressure chambers are arranged in a matrix along a surface of the head, an ink-jet head is known in which a nozzle is disposed at the center of each pressure chamber in a view perpendicular to the head surface. In this case, when pulse pressure is applied to a pressure chamber, a pressure wave propagates in the pressure chamber perpendicularly to the head surface. Ink is then ejected through the corresponding nozzle disposed at the center of the pressure chamber in a view perpendicular to the head surface.

Here, in a case of ejecting ink by using a pressure wave, there is known a so-called "fill after fire" method, in which a positive pressure is applied to a pressure chamber, and a so-called "fill before fire" method, in which at first a negative pressure is applied to a pressure chamber and then, at a predetermined timing after a negative pressure wave has been reversed and reflected, a positive pressure is applied. In these two methods of "fill after fire" and the "fill before fire", it is said that the "fill before fire" generally has a higher energy efficiency. Moreover, when a pressure wave propagates in a pressure chamber perpendicularly to the head surface, as in the aforementioned conventional example, the propagation time length of the pressure waves (i.e., AL: Acoustic Length) is extremely short, so long as a head is not large-sized. Furthermore, if the "fill before fire" is performed in the case of a short AL, the time period for the pressure waves to be reversed and returned becomes short, so that a time interval between timings for a negative pressure and for a positive pressure also becomes short.

Because of this, a highly responsive and expensive drive circuit is necessary to be used in the ink-jet head. In addition, if the "fill after fire" is performed in order to avoid the above necessity, a large energy has to be inputted to the ink-jet head, so that the problem of a poor energy efficiency can be raised.

SUMMARY OF THE INVENTION

The invention thus provides an ink-jet head which can achieve a high resolution and a high printing speed and can improve energy efficiency, and to provide an ink-jet printer having the ink-jet head.

According to a first exemplary aspect of the invention, there is provided an ink-jet head having a passage unit including a plurality of pressure chambers each having one end connected with a nozzle and another end connected with an ink supply source. Each of the pressure chambers is confined in one of a plurality of parallelogram regions which has a planar shape of a 2n-angled shape (n: a natural number, $n \geqq 3$) with no corner bulging in a direction to leave a line joining the one end and the another end in each of the pressure chambers, in a plane of the passage unit where the pressure chambers are arranged. A first direction along a longer diagonal line of the parallelogram region and a second direction joining the one end and the another end in each of the pressure chambers are substantially coincident with each other.

According to a second exemplary aspect of the invention, there is provided an ink-jet printer having an ink-jet head. The ink-jet head includes a passage unit having a plurality of pressure chambers each having one end connected with a nozzle and another end connected with an ink supply source. Each of the pressure chambers is confined in one of a plurality of parallelogram regions and has a planar shape of a 2n-angled shape (n: a natural number, $n \geqq 3$) with no corner bulging in a direction to leave a line joining the one end and the another end in each of the pressure chambers, in a plane of the passage unit where the pressure chambers are arranged. A first direction along a longer diagonal line of the parallelogram region and a second direction joining the one end and the another end in each of the pressure chambers are substantially coincident with each other.

According to a third exemplary aspect of the invention, there is provided an ink-jet head having a passage unit including a plurality of pressure chambers each having one end connected with a nozzle and another end connected with an ink supply source. Each of the pressure chambers is confined in one of a plurality of parallelogram regions and has an elliptical planar shape with no corner bulging in a direction to leave a line joining the one end and the another end in each of the pressure chambers, in a plane of the passage unit where the pressure chambers are arranged. A first direction along the longer diagonal line of the parallelogram region and a second direction joining the one end and the another end in each of the pressure chambers are substantially coincident with each other.

According to a fourth exemplary aspect of the invention, there is provided an ink-jet printer including an ink-jet head. The ink-jet head includes a passage unit having a plurality of pressure chambers each having one end connected with a nozzle and another end connected with an ink supply source. Each of the pressure chambers is confined in each of a plurality of parallelogram regions and has an elliptical planar shape with no corner bulging in a direction to leave a line joining the one end and the another end in each of the pressure chambers, in a plane of the passage unit where the pressure chambers are arranged. A first direction along the longer diagonal line of the parallelogram region and a second direction joining the one end and the another end in each of the pressure chambers are substantially coincident with each other.

In this construction, in an ink-jet head and an ink-jet printer capable of achieving the high resolution and the high printing speed, a second direction joining one end connected with the nozzle and the another end connected with the ink supply source in each of pressure chambers is substantially parallel to a plane of the passage unit where the pressure chambers are arranged. As a result, a pressure wave to be generated in the pressure chamber propagates substantially along the plane of the passage unit where the pressure chambers are arranged. When the pressure wave thus propagates along the plane of the passage unit having the pressure chambers arranged, AL can be relatively long without increasing the head thickness (a length of the head in a direction perpendicular to the plane). This provides a margin in time for matching the timings of generation and reflection of the pressure wave, and thus, "fill before fire" can be performed, and improvement of energy efficiency is achieved compared with the case of the "fill after fire".

BRIEF DESCRIPTION OF THE DRAWINGS

Other and further objects, features and advantages of the invention will appear more fully from the following description taken in connection with the accompanying drawing which.

DETAILED DESCRIPTION OF PREFERRED EMBODIMENTS

Figure 1:
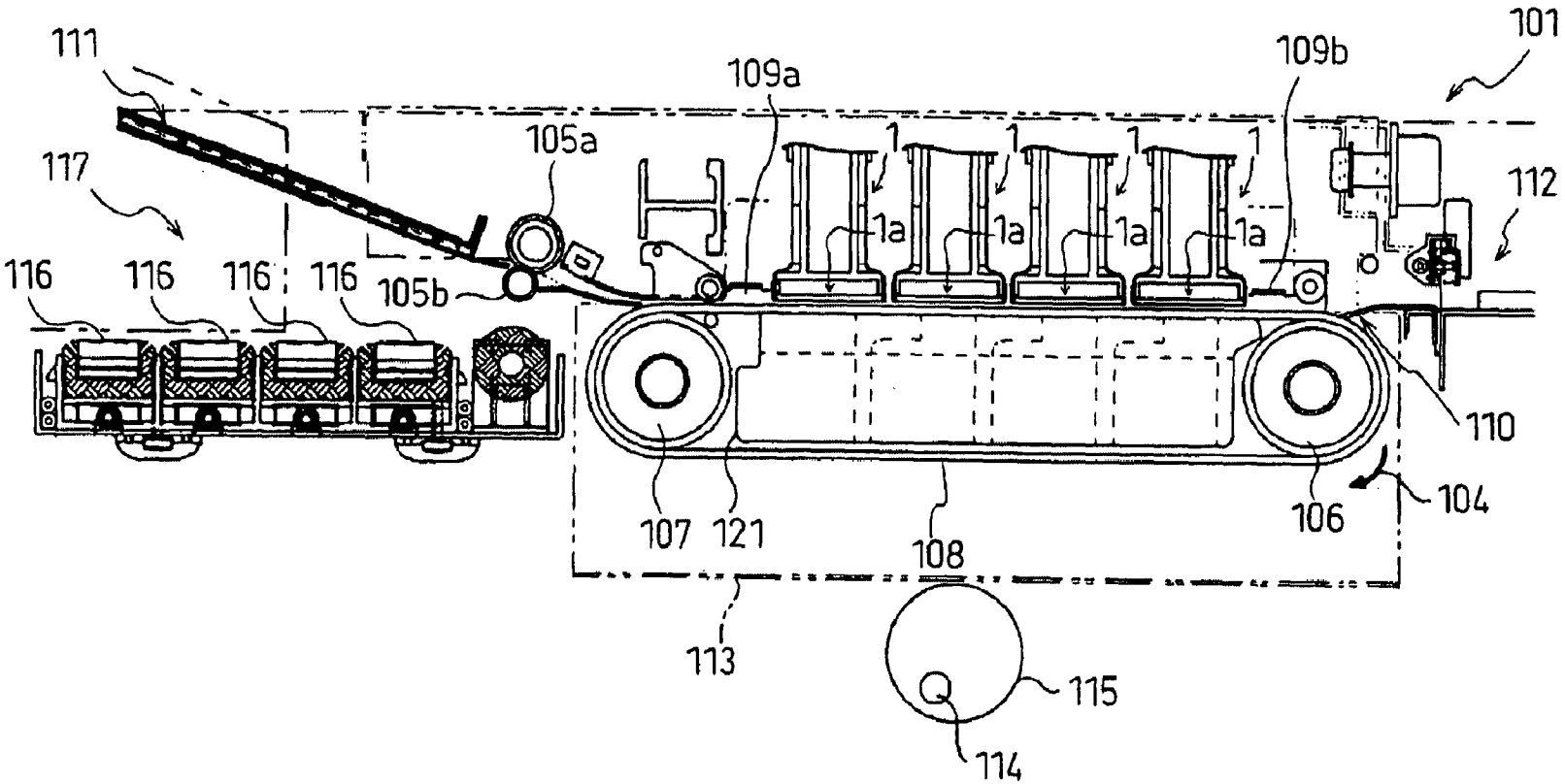
FIG. 1 is a general view of an ink-jet printer including ink-jet heads according to an embodiment of the invention.

FIG. 1 is a general view of an ink-jet printer including ink-jet heads according to an embodiment of the invention. The ink-jet printer 101 as illustrated in FIG. 1 is a color ink-jet printer having four ink-jet heads 1. In this printer 101, a paper feed unit 111 and a paper discharge unit 112 are disposed in left and right portions of FIG. 1, respectively.

In the printer 101, a paper transfer path is provided extending from the paper feed unit 111 to the paper discharge unit 112. A pair of feed rollers 105*a* and 105*b* is disposed immediately downstream of the paper feed unit 111 for pinching and putting forward a paper as an image record medium. By the pair of feed rollers 105*a* and 105*b*, the paper is transferred from the left to the right in FIG. 1. In the middle of the paper transfer path, two belt rollers 106 and 107 and an endless transfer belt 108 are disposed. The transfer belt 108 is wound on the belt rollers 106 and 107 to extend between them. The outer face, i.e., the transfer face, of the transfer belt 108 has been treated with silicone. Thus, a paper fed through the pair of feed rollers 105*a* and 105*b* can be held on the transfer face of the transfer belt 108 by the adhesion of the face. In this state, the paper is transferred downstream (rightward) by driving one belt roller 106 to rotate clockwise in FIG. 1 (the direction indicated by an arrow 104).

Pressing members 109*a* and 109*b* are disposed at positions for feeding a paper onto the belt roller 106 and taking out the paper from the belt roller 106, respectively. Either of the pressing members 109*a* and 109*b* is for pressing the paper onto the transfer face of the transfer belt 108 so as to prevent the paper from separating from the transfer face of the transfer belt 108. Thus, the paper surely adheres to the transfer face.

A peeling device 110 is provided immediately downstream of the transfer belt 108 along the paper transfer path. The peeling device 110 peels off the paper, which has adhered to the transfer face of the transfer belt 108, in order to transfer the paper toward the rightward paper discharge unit 112.

Each of the four ink-jet heads 1 has, at its lower end, a head main body 1*a*. Each head main body 1*a* has a rectangular section. The head main bodies 1*a* are arranged close to each other with the longitudinal axis of each head main body 1*a* being perpendicular to the paper transfer direction (perpendicular to FIG. 1). That is, this printer 101 is a line type. The bottom of each of the four head main bodies 1*a* faces the paper transfer path. In the bottom of each head main body 1*a*, a number of nozzles are provided each having a small-diameter ink ejection port. The four head main bodies 1*a* eject ink of magenta, yellow, cyan, and black, respectively.

The head main bodies 1*a* are disposed such that a narrow clearance must be formed between the lower face of each head main body 1*a* and the transfer face of the transfer belt 108. The paper transfer path is formed within the clearance. In this construction, while a paper, which is being transferred by the transfer belt 108, passes immediately below the four head main bodies 1*a* in order, the respective color inks are ejected through the corresponding nozzles toward the upper face, i.e., the print face, of the paper to form a desired color image on the paper.

The ink-jet printer 101 is provided with a maintenance unit 117 for automatically carrying out maintenance of the ink-jet heads 1. The maintenance unit 17 includes four caps 116 for covering the lower faces of the four head main bodies 1*a*, and a not-illustrated purge system.

The maintenance unit 117 is at a position immediately below the paper feed unit 111 (withdrawal position) while the ink-jet printer 101 is printing. When a predetermined condition is satisfied after finishing the printing operation (for example, when a state in which no printing operation is performed continues for a predetermined time period or when the printer 101 is powered off), the maintenance unit 117 moves to a position immediately below the four head main bodies 1*a* (cap position), where the maintenance unit 117 covers the lower faces of the head main bodies 1*a* with the respective caps 116 to prevent ink in the nozzles of the head main bodies 1*a* from being dried.

The belt rollers 106 and 107 and the transfer belt 108 are supported by a chassis 113. The chassis 113 is put on a cylindrical member 115 disposed under the chassis 113. The cylindrical member 115 is rotatable around a shaft 114 provided at a position deviating from the center of the cylindrical member 115. Thus, by rotating the shaft 114, the level of the uppermost portion of the cylindrical member 115 can be changed to move up or down the chassis 113 accordingly. When the maintenance unit 117 is moved from the withdrawal position to the cap position, the cylindrical member 115 must rotate at a predetermined angle in advance so as to move down the transfer belt 108 and the belt rollers 106 and 107 by a pertinent distance from the position illustrated in FIG. 1. A space for the movement of the maintenance unit 117 is thereby ensured.

In the region surrounded by the transfer belt 108, a nearly rectangular parallelepiped guide 121 (having its width substantially equal to that of the transfer belt 108) is disposed at an opposite position to the ink-jet heads 1. The guide 121 is in contact with the lower face of the upper part of the transfer belt 108 to support the upper part of the transfer belt 108 from the inside.

Figure 2:
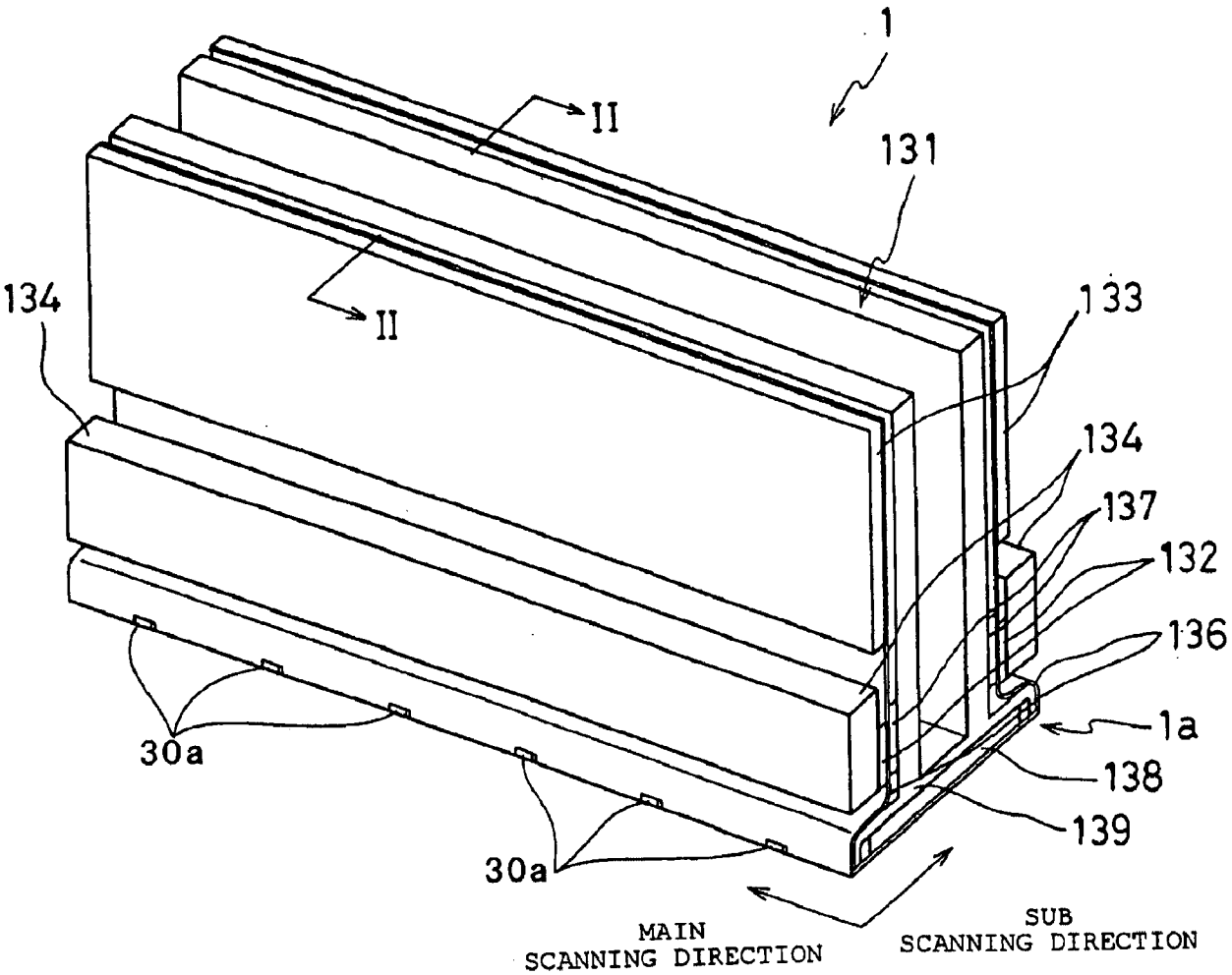
FIG. 2 is a perspective view of an ink-jet head according to the embodiment of the invention.
Figure 3:
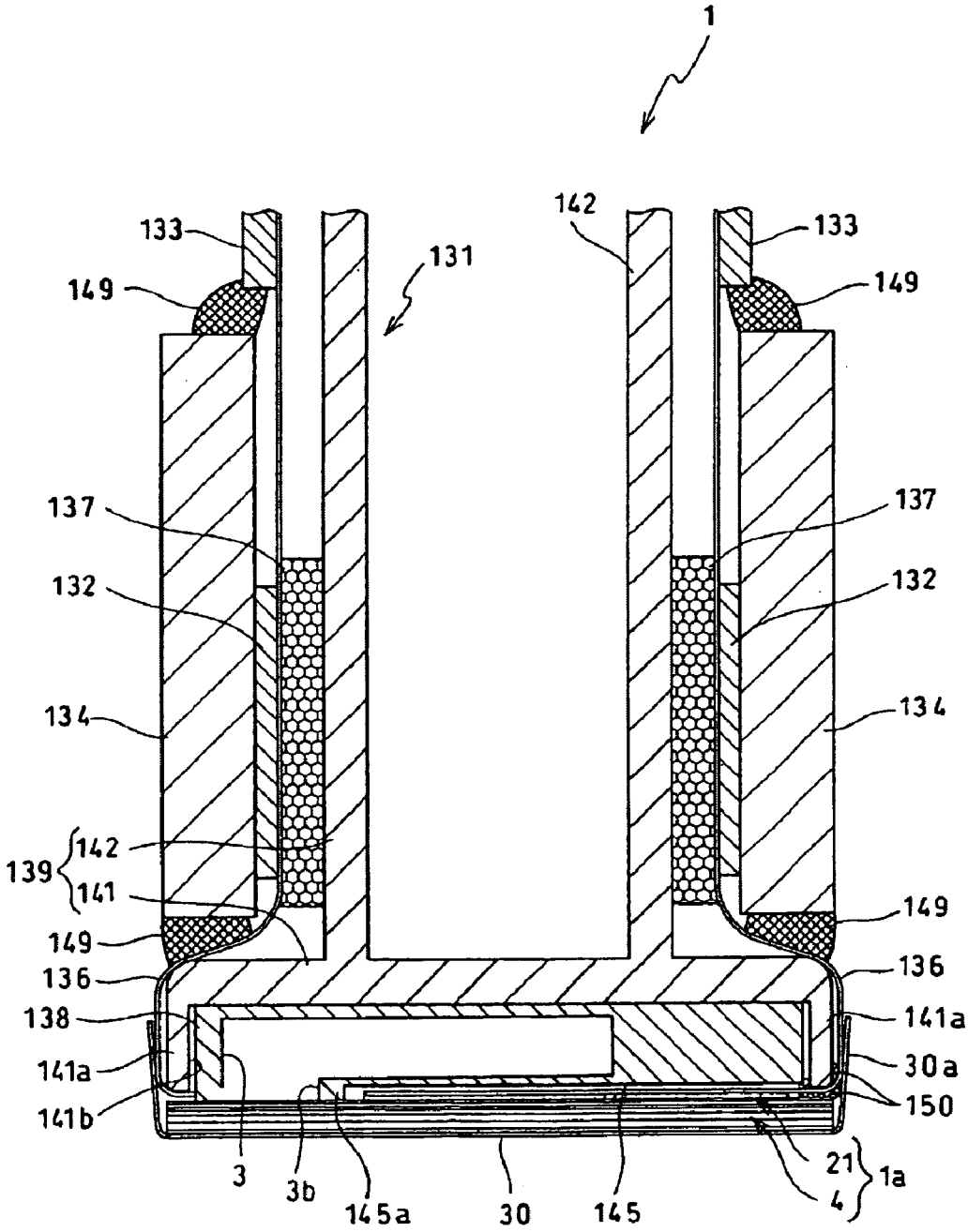
FIG. 3 is a sectional view taken along line II—II in FIG. 2.

Next, the construction of each ink-jet head 1 according to this embodiment will be described in more detail. FIG. 2 is a perspective view of the ink-jet head 1. FIG. 3 is a sectional view taken along line II—II in FIG. 2. Referring to FIGS. 2 and 3, the ink-jet head 1 according to this embodiment includes a head main body 1*a* having a rectangular shape in a plan view and extending in one direction (main scanning direction), and a base portion 131 for supporting the head main body 1*a*. The base portion 131 supporting the head main body 1*a* further supports thereon driver ICs 132 for supplying driving signals to individual electrodes 35*a* and 35*b* (see FIG. 6 and FIG. 10), and substrates 133.

Referring to FIG. 2, the base portion 131 is made up of a base block 138 partially bonded to the upper face of the head main body 1*a* to support the head main body 1*a*, and a holder 139 bonded to the upper face of the base block 138 to support the base block 138. The base block 138 is a nearly rectangular parallelepiped member having substantially the same length of the head main body 1*a*. The base block 138 made of metal material such as stainless steel, and has a function as a light structure for reinforcing the holder 139. The holder 139 is made up of a holder main body 141 disposed near the head main body 1*a*, and a pair of holder support portions 142 each extending on the opposite side of the holder main body 141 to the head main body 1*a*. Each holder support portion 142 is a flat member. These holder support portions 142 extend along the longitudinal direction of the holder main body 141 and are disposed in parallel with each other at a predetermined interval.

Skirt portions 141*a* in a pair, protruding downward, are provided in both end portions of the holder main body 141*a* in a sub scanning direction (perpendicular to the main scanning direction). Either skirt portion 141*a* is formed through the length of the holder main body 141. As a result, in the lower portion of the holder main body 141, a nearly rectangular parallelepiped groove 141*b* is defined by the pair of skirt portions 141*a*. The base block 138 is received in the groove 141*b*. The upper surface of the base block 138 is bonded to the bottom of the groove 141*b* of the holder main body 141 with an adhesive. The thickness of the base block 138 is somewhat larger than the depth of the groove 141*b* of the holder main body 141. As a result, the lower end of the base block 138 protrudes downward beyond the skirt portions 141*a*.

Within the base block 138, as a passage for ink to be supplied to the head main body 1*a*, an ink reservoir 3 is formed as a nearly rectangular parallelepiped space (hollow region) extending along the longitudinal direction of the base block 138. In the lower face 145 of the base block 138, openings 3*b* (see FIG. 4) are formed each communicating with the ink reservoir 3. The ink reservoir 3 is connected through a not-illustrated supply tube with a not-illustrated main ink tank (ink supply source) within the printer main body. Thus, the ink reservoir 3 is suitably supplied with ink from the main ink tank.

In the lower face 145 of the base block 138, the vicinity of each opening 3*b* protrudes downward from the surrounding portion. The base block 138 is in contact with a passage unit 4 (see FIG. 3) of the head main body 1*a* at the vicinity portion 145*a* of each opening 3*b* of the lower face 145. Thus, the region of the lower face 145 of the base block 138, other than the vicinity portion 145*a* of each opening 3*b*, is distant from the head main body 1*a*. Actuator units 21 are disposed within the distance.

To the outer side face of each holder support portion 142 of the holder 139, a driver IC 132 is fixed with an elastic member 137 such as a sponge being interposed between them. A heat sink 134 is disposed in close contact with the outer side face of the driver IC 132. The heat sink 134 is made of a nearly rectangular parallelepiped member for efficiently radiating heat generated in the driver IC 132. A flexible printed circuit (FPC) 136 as a power supply member is connected with the driver IC 132. The FPC 136 connected with the driver IC 132 is bonded to and electrically connected with the corresponding substrate 133 and the head main body 1*a* by soldering. The substrate 133 is disposed outside the FPC 136 above the driver IC 132 and the heat sink 134. The upper face of the heat sink 134 is bonded to the substrate 133 with a seal member 149. Also, the lower face of the heat sink 134 is bonded to the FPC 136 with a seal member 149.

Between the lower face of each skirt portion 141*a* of the holder main body 141 and the upper face of the passage unit 4, a seal member 150 is disposed to sandwich the FPC 136. The FPC 136 is fixed by the seal member 150 to the passage unit 4 and the holder main body 141. Therefore, even if the head main body 1*a* is elongated, the head main body 1*a* can be prevented from being bent, the interconnecting portion between each actuator unit and the FPC 136 can be prevented from receiving stress, and the FPC 136 can surely be held.

Referring to FIG. 2, in the vicinity of each lower corner of the ink-jet head 1 along the main scanning direction, six protruding portions 30*a* are disposed at regular intervals along the corresponding side wall of the ink-jet head 1. These protruding portions 30*a* are provided at both ends in the sub scanning direction of a nozzle plate 30 in the lowermost layer of the head main body 1*a* (see FIG. 7). The nozzle plate 30 is bent by about 90 degrees along the boundary line between each protruding portion 30*a* and the other portion. The protruding portions 30*a* are provided at positions corresponding to the vicinities of both ends of various papers to be used for printing. Each bent portion of the nozzle plate 30 has a shape not right-angled but rounded.

This makes it hard to bring about clogging of a paper, i.e., jamming, which may occur because the leading edge of the paper, which has been transferred to approach the head 1, is stopped by the side face of the head 1.

Figure 4:
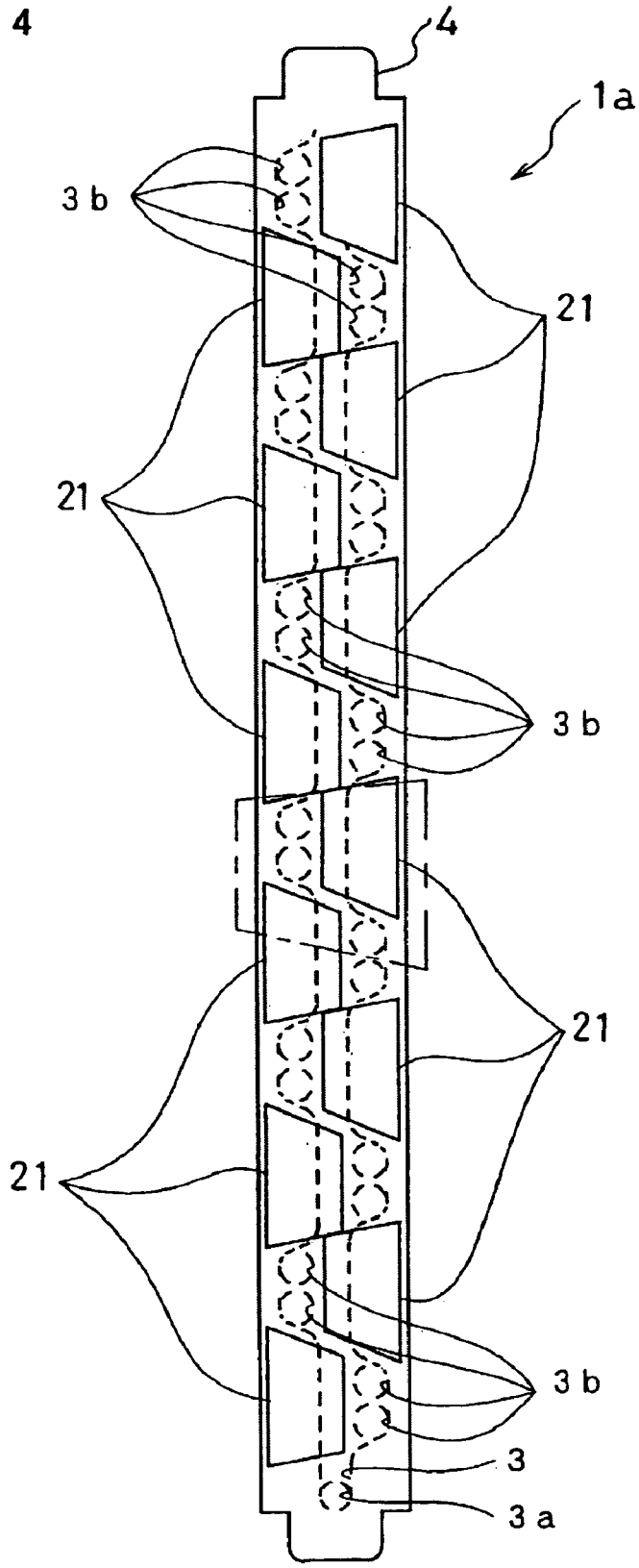
FIG. 4 is a plan view of a head main body included in the ink-jet head of FIG. 2.

FIG. 4 is a schematic plan view of the head main body 1*a*. In FIG. 4, an ink reservoir 3 formed in the base block 138 is imaginarily illustrated with a broken line. Referring to FIG. 4, the head main body 1*a* has a rectangular shape in the plan view extending in one direction (main scanning direction). The head main body 1*a* includes a passage unit 4 in which a large number of pressure chambers 10 and a large number of ink ejection ports 8 at the front ends of nozzles (as for both, see FIGS. 5, 6, and 7), as described later. Trapezoidal actuator units 21 arranged in two lines in a staggered shape are bonded onto the upper face of the passage unit 4. Each actuator unit 21 is disposed such that its parallel opposed sides (upper and lower sides) extend along the longitudinal direction of the passage unit 4. The oblique sides of each neighboring actuator units 21 overlap each other in the lateral direction of the passage unit 4.

The lower face of the passage unit 4 corresponding to the bonded region of each actuator unit 21 is made into an ink ejection region. In the surface of each ink ejection region, a large number of ink ejection ports 8 are arranged in a matrix, as described later. In the base block 138 disposed above the passage unit 4, an ink reservoir 3 is formed along the longitudinal direction of the base block 138. The ink reservoir 3 communicates with an ink tank (not illustrated) through an opening 3*a* provided at one end of the ink reservoir 3, so that the ink reservoir 3 is always filled up with ink. In the ink reservoir 3, pairs of openings 3*b* are provided in regions where no actuator unit 21 is present, so as to be arranged in a staggered shape along the longitudinal direction of the ink reservoir 3.

Figure 5:
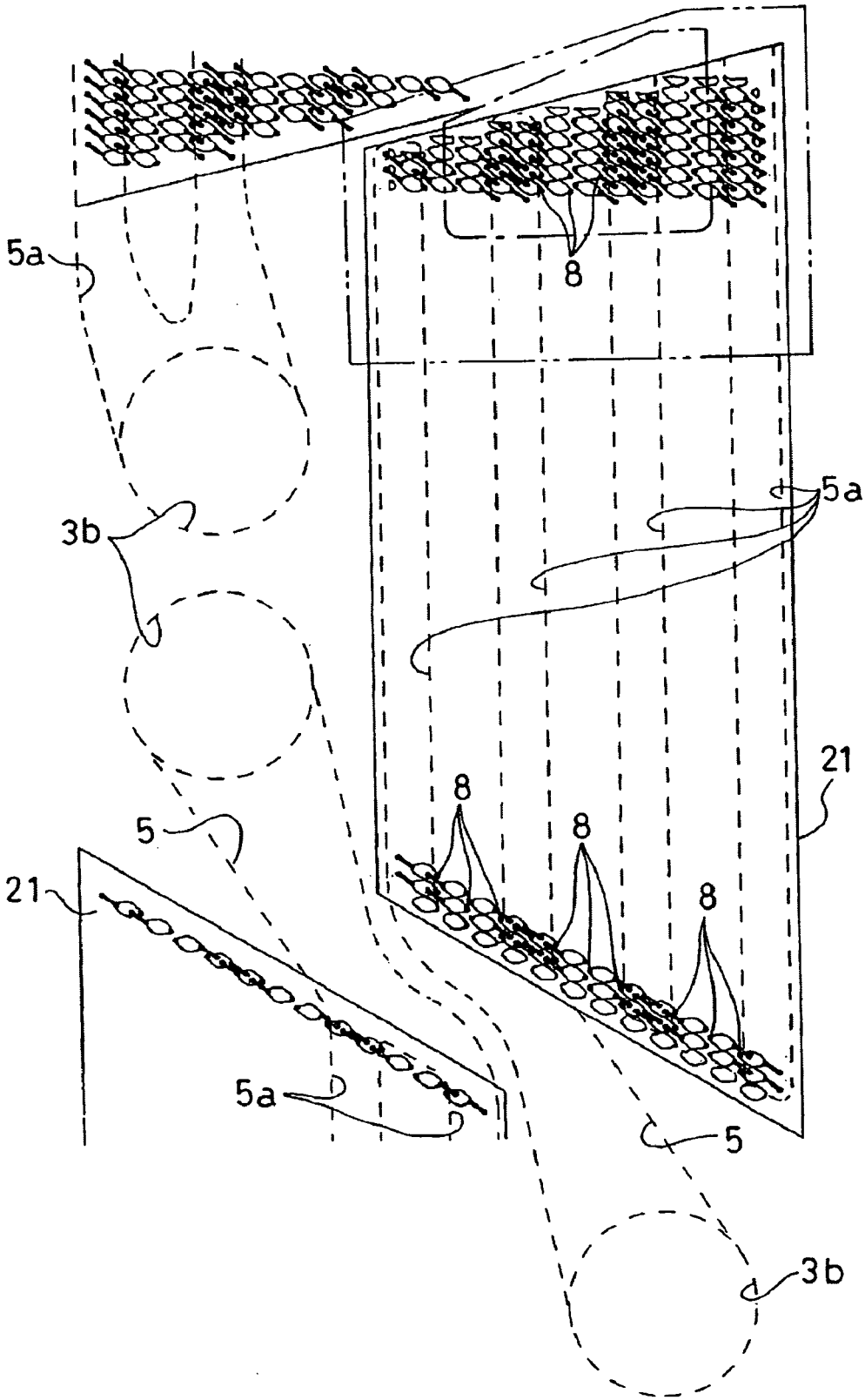
FIG. 5 is an enlarged view of the region enclosed with an alternate long and short dash line in FIG. 4.

FIG. 5 is an enlarged view of the region enclosed with an alternate long and short dash line in FIG. 4. Referring to FIGS. 4 and 5, the ink reservoir 3 communicates through each opening 3*b* with a manifold channel 5 disposed under the opening 3*b*. Each opening 3*b* is provided with a filter (not illustrated) for catching dust and dirt contained in ink. The front end portion of each manifold channel 5 branches into two sub-manifold channels 5*a*. Below a single one of the actuator unit 21, two sub-manifold channels 5*a* extend from each of the two openings 3*b* on both sides of the actuator unit 21 in the longitudinal direction of the ink-jet head 1. That is, below the single actuator unit 21, four sub-manifold channels 5*a* in total extend along the longitudinal direction of the ink-jet head 1. Each sub-manifold channel 5*a* is filled up with ink supplied from the ink reservoir 3.

Figure 6:
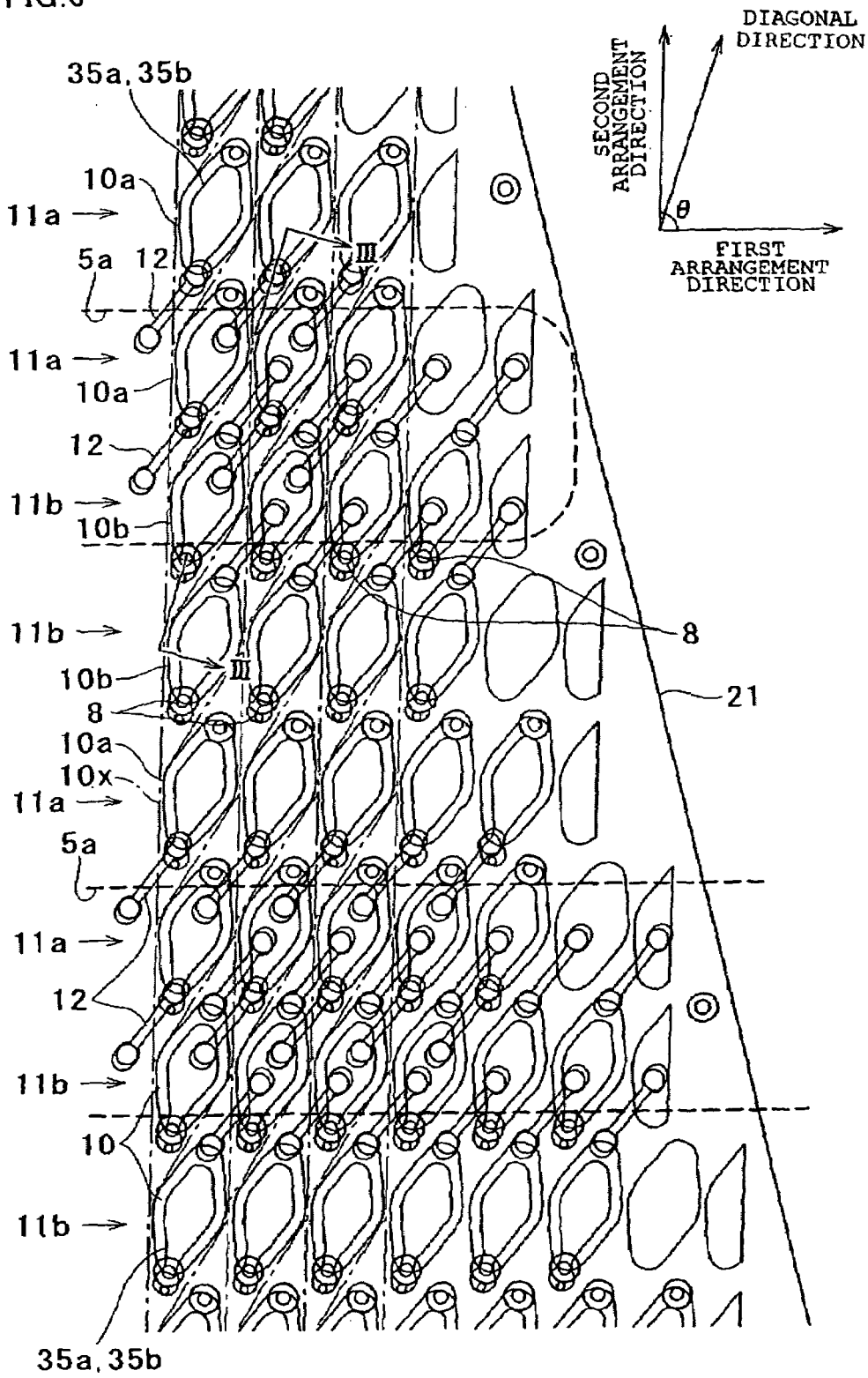
FIG. 6 is an enlarged view of the region enclosed with an alternate long and short dash line in FIG. 5.

FIG. 6 is an enlarged view of the region enclosed with an alternate long and short dash line in FIG. 5. Either of FIGS. 5 and 6 is a vertical view of a plane in which many pressure chambers 10 are arranged in a matrix in the passage unit 4. Pressure chambers 10, apertures 12, injection port 8, sub-manifold channels, etc., as components of the passage unit 4, are disposed at different levels from one another perpendicularly to FIGS. 5 and 6 (see FIG. 7).

As shown in FIG. 6, a number of rhombic regions 10*x* (as shown by alternate long and short dash lines) are so arranged adjacent to each other in a matrix in two directions, a first arrangement direction and a second arrangement direction as indicated by arrows in FIG. 6, so that they do not overlap each other but share their individual sides. The first arrangement direction and the second arrangement direction are parallel to the plane of a trapezoidal ink ejection region, as shown in FIG. 5. The first arrangement direction is coincident with the longitudinal direction of the passage unit 4, whereas the second arrangement direction is coincident with the direction along one oblique side of the rhombic region 10*x*. The pressure chamber 10 has a substantially elliptic planar shape slightly smaller than the rhombic regions 10*x* and is individually housed in the region 10*x*.

Each of the pressure chambers 10 is connected at its one end with the nozzle and at its other end with the sub-manifold channel 5*a*, as will be described in detail. The one end connected with the nozzle and the other end connected with the sub-manifold channel 5*a* in each pressure chamber 10 are disposed separately at the two ends of the longer diagonal of each rhombic region 10*x*. In other words, the direction taken along the longer diagonal line of the rhombic region 10*x* (i.e., the diagonal direction: a first direction) and the direction joining the one end and the other end of each pressure chamber 10 (i.e., the two-end direction: a second direction) are coincident with each other, as shown in FIG. 6. Of the pressure waves which are generated in the pressure chamber 10 when a pressure is applied to the pressure chamber 10 by the actuator unit 21, therefore, the pressure wave propagating in the direction joining the one end and the other end of the pressure chamber 10 (i.e., the two-end direction: the second direction) is used as to contribute to the ejection of ink.

In case the propagating direction of the pressure wave used for ejection (as will be shortly called the "pressure wave") is perpendicular to the place, it is common for the planar shape of the pressure chamber 10 to be symmetrically with respect to an origin, such as a circle or a polygon. When the propagation direction of the pressure wave is along the plane of the passage unit 4, as in this embodiment, however, for elongating the propagation time length of the pressure waves (i.e., AL: Acoustic Length), it is preferable to have a slender planar shape for the pressure chamber 10 along the propagation direction of the pressure waves, i.e., the direction joining the one end and the other end (i.e., the two-end direction: the second direction). For this reason, the planar shape of the pressure chamber 10 shown in FIG. 6 is elliptical, in which the length in the two-end direction (the second direction) is longer than the length in the direction perpendicular thereto.

As shown in FIG. 6, the first arrangement direction and the second arrangement direction of the matrix arrangement of the pressure chambers 10 do not intersect at a right angle but make an acute angle 'theta'. As a result, the spacing between each of the ink ejection ports 8 in the scanning direction of the ink-jet head 1 is narrowed. Thus, the image formation of a high resolution by the printing method described hereinafter.

FIG. 6 illustrates pairs of individual electrodes 35*a* and 35*b* each overlapping the corresponding pressure chamber 10 in a plan view and having a shape in a plan view similar to that of the pressure chamber 10 and somewhat smaller than the pressure chamber 10.

Figure 7:
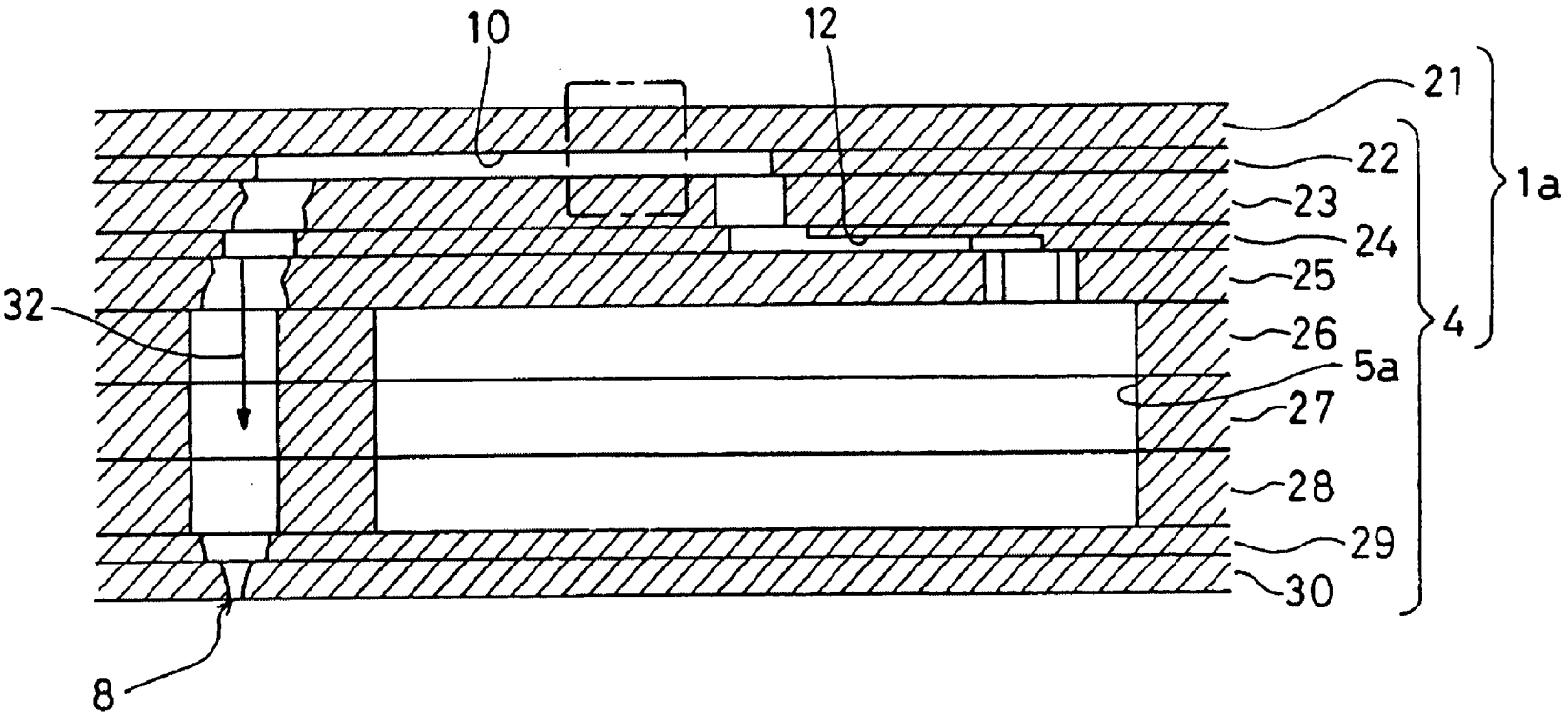
FIG. 7 is a partial sectional view of the head main body of FIG. 4 taken along line III—III in FIG. 6.

FIG. 7 is a partial sectional view of the head main body 1*a* of FIG. 4. As apparent from FIG. 7, each ink ejection port 8 is formed at the tip end of a tapered nozzle. Between a pressure chamber 10 and a sub-manifold channel 5*a*, an aperture 12 extends substantially in parallel with the surface of the passage unit 4, like the pressure chamber 10. This aperture 12 is for restricting the ink flow to give the passage a suitable resistance, thereby intending the stabilization of ink ejection. Each ink ejection port 8 communicates with a sub-manifold channel 5*a* through a pressure chamber 10 (length: 900 $\mu$m, width: 350 $\mu$m) and an aperture 12. Thus, within the ink-jet head 1 formed are ink passages 32 each extending from an ink tank to an ink ejection port 8 through an ink reservoir 3, a manifold channel 5, a sub-manifold channel 5*a*, an aperture 12, and a pressure chamber 10.

When viewing perpendicularly to FIG. 6, the aperture 12, communicating with a pressure chamber 10, is disposed so as to overlap another pressure chamber 10 neighboring that pressure chamber 10. This arrangement is possible because the aperture 12 is disposed on the sub-manifold channel 5*a* side of the pressure chamber 10 with respect to a direction perpendicular to FIG. 6 and it is provided at the different level from the pressure chamber 10. Referring to FIG. 7, each of the pressure chamber 10, the aperture 12, and the sub-manifold channel 5*a* is formed within layered sheet members. In a view perpendicular to the surface of the passage unit 4, they are disposed so as to overlap one another.

In FIGS. 5 and 6, to make it easy to understand the drawings, the pressure chambers 10, the apertures 12, etc., are illustrated with solid lines though they should be illustrated with broken lines because they are below the actuator unit 21.

In the plane of FIGS. 5 and 6, pressure chambers 10 are arranged within an ink ejection region in two directions, i.e., a direction along the length of the ink-jet head 1 (a first arrangement direction) and a direction somewhat inclining from the width of the ink-jet head 1 (a second arrangement direction). The first and second arrangement directions form an angle 'theta' somewhat smaller than the right angle. The ink ejection ports 8 are arranged at 50 dpi in the first arrangement direction. On the other hand, the pressure chambers 10 are arranged in the second arrangement direction such that the ink ejection region corresponding to one actuator unit 21 may include twelve pressure chambers 10. The shift to the first arrangement direction due to the arrangement in which twelve pressure chambers 10 are arranged in the second arrangement direction, corresponds to one pressure chamber 10. Therefore, within the whole width of the ink-jet head 1, in a region of the interval between two ink ejection ports 8 neighboring each other in the first arrangement direction, there are twelve ink ejection ports 8. At both ends of each ink ejection region in the first arrangement direction (corresponding to an oblique side of the actuator unit 21), the above condition is satisfied by making a compensation relation to the ink ejection region corresponding to the opposite actuator unit 21 in the width of the ink-jet head 1. Therefore, in the ink-jet head 1 according to this embodiment, by ejecting ink droplets in order through a large number of ink ejection ports 8 arranged in the arrangement directions A and B with relative movement of a paper along the width of the ink-jet head 1, printing at 600 dpi in the main scanning direction can be performed.

Figure 8:
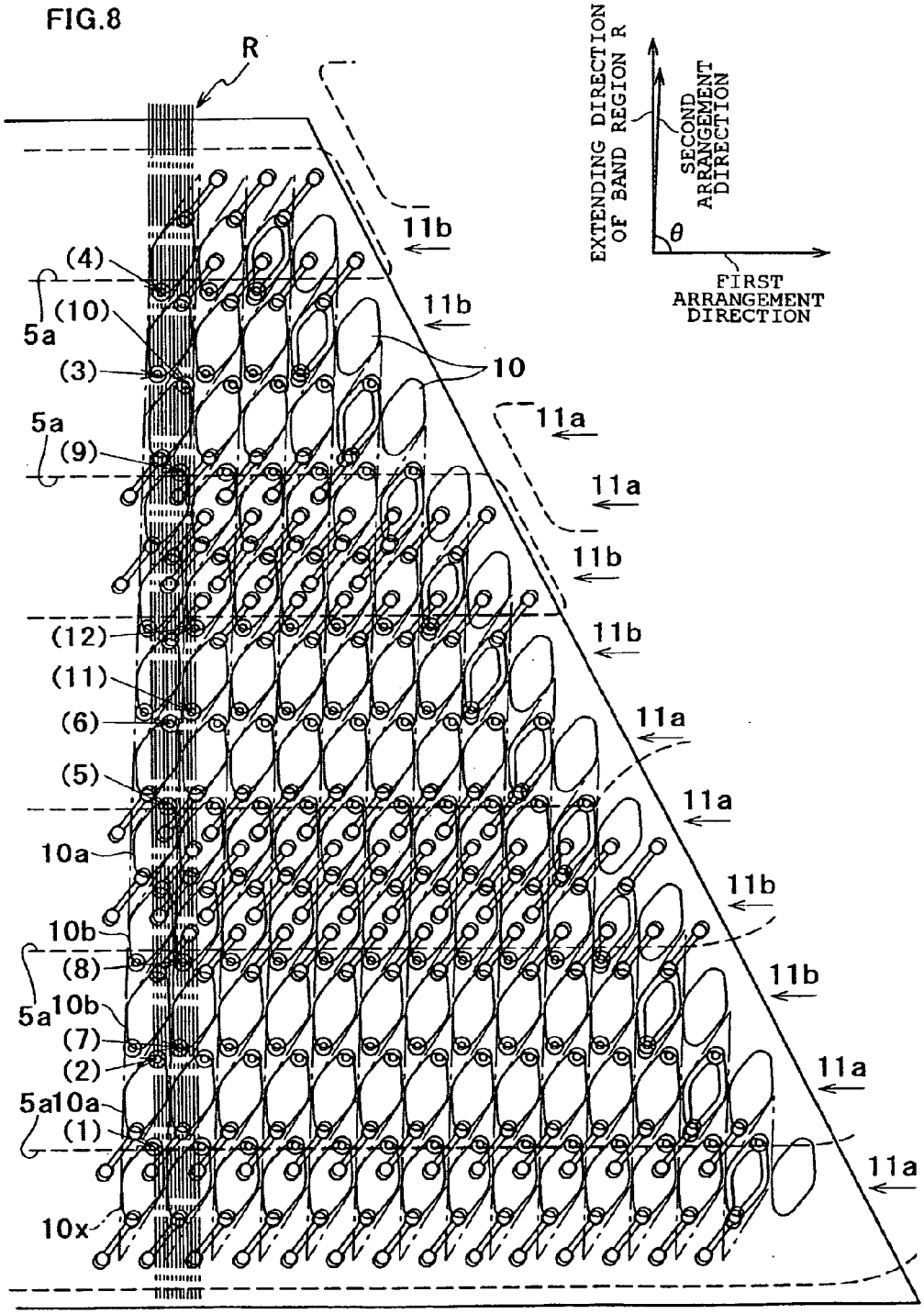
FIG. 8 is an enlarged view of the region enclosed with an alternate long and two short dashes line in FIG. 5.

Next, the construction of the passage unit 4 will be described in more detail with reference to FIG. 8. Referring to FIG. 8, pressure chambers 10 are arranged in lines in the first arrangement direction at predetermined intervals at 500 dpi. Twelve lines of pressure chambers 10 are arranged in the first and second arrangement directions, the pressure chambers 10 are two-dimensionally arranged in the ink ejection region corresponding to one actuator unit 21.

The pressure chambers 10 are classified into two kinds, i.e., pressure chambers 10*a* in each of which a nozzle is connected with the upper acute portion in FIG. 8, and pressure chambers 10*b* in each of which a nozzle is connected with the lower acute portion. Pressure chambers 10*a* and 10*b* are arranged in the first arrangement direction to form pressure chamber rows 11*a* and 11*b*, respectively. Referring to FIG. 8, in the ink ejection region corresponding to one actuator unit 21, from the lower side of FIG. 8, there are disposed two pressure chamber rows 11*a* and two pressure chamber rows 11*b* neighboring the upper side of the pressure chamber rows 11*a*. The four pressure chamber rows of the two pressure chamber rows 11*a* and the two pressure chamber rows 11*b* constitute a set of pressure chamber rows. Such a set of pressure chamber rows is repeatedly disposed three times from the lower side in the ink ejection region corresponding to one actuator unit 21. A straight line extending through the upper acute portion of each pressure chamber in each pressure chamber rows 11*a* and 11*b* crosses the lower oblique side of each pressure chamber in the pressure chamber row neighboring the upper side of that pressure chamber row.

As described above, when viewing perpendicularly to FIG. 8, two pressure chamber rows 11*a* and two pressure chamber rows 11*b*, in which nozzles connected with pressure chambers 10 are disposed at different positions, are arranged alternately to neighbor each other. Consequently, as the whole, the pressure chambers 10 are arranged regularly. On the other hand, nozzles are arranged in a concentrated manner in a central region of each set of pressure chamber rows constituted by the above four pressure chamber rows. Therefore, in case that each four pressure chamber rows constitute a set of pressure chamber rows and such a set of pressure chamber rows is repeatedly disposed three times from the lower side as described above, there is formed a region where no nozzle exists, in the vicinity of the boundary between each neighboring sets of pressure chamber rows, i.e., on both sides of each set of pressure chamber rows constituted by four pressure chamber rows. In this region were no nozzles exist, the sub-manifold channels 5*a* extend in order to supply ink to the corresponding pressure chambers 10. In this embodiment, in the ink ejection region corresponding to one actuator unit 21, four wide sub-manifold channels 5*a* in total are arranged in the first arrangement direction, i.e., one on the lower side of FIG. 8, one between the lowermost set of pressure chamber rows and the second lowermost set of pressure chamber rows, and two on both sides of the uppermost set of pressure chamber rows.

Referring to FIG. 8, nozzles communicating with ink ejection ports 8 for ejecting ink are arranged in the first arrangement direction at regular intervals at 50 dpi to correspond to the respective pressure chambers 10 regularly arranged in the first arrangement direction. On the other hand, while twelve pressure chambers 10 are regularly arranged also in the second arrangement direction forming an angle 'theta' with the first arrangement direction, twelve nozzles corresponding to the twelve pressure chambers 10 each communicate with the upper acute portion of the corresponding pressure chamber 10 and each communicate with the lower acute portion of the corresponding pressure chamber 10. As a result, they are not regularly arranged in the second arrangement direction at regular intervals.

If all nozzles communicate with the same-side acute portions of the respective pressure chambers 10, the nozzles are regularly arranged also in the second arrangement direction at regular intervals. In this case, nozzles are arranged so as to shift in the first arrangement direction by a distance corresponding to 600 dpi as resolution upon printing per pressure chamber row from the lower side to the upper side of FIG. 8. Contrastingly in this embodiment, since four pressure chamber rows of two pressure chamber rows 11*a* and two pressure chamber rows 11*b* constitute a set of pressure chamber rows and such a set of pressure chamber rows is repeatedly disposed three times from the lower side, the shift of nozzle position in the first arrangement direction per pressure chamber row from the lower side to the upper side of FIG. 8 is not always the same.

In the ink-jet head 1 according to this embodiment, a band region R will be discussed that has a width (about 508.0 μm) corresponding to 50 dpi in the first arrangement direction and extends perpendicularly to the first arrangement direction. In this band region R, any of twelve pressure chamber rows includes only one nozzle. That is, when such a band region R is defined at an optional position in the ink ejection region corresponding to one actuator unit 21, twelve nozzles are always distributed in the band region R. The positions of points respectively obtained by projecting the twelve nozzles onto a straight line extending in the first arrangement direction are distant from each other by a distance corresponding to 600 dpi as resolution upon printing.

When the twelve nozzles included in one band region R are denoted by (1) to (12) in order from one whose projected image onto a straight line extending in the first arrangement direction is the leftmost, the twelve nozzles are arranged in the order of (1), (7), (2), (8), (5), (11), (6), (12), (9), (3), (10), and (4) from the lower side.

In the thus-constructed ink-jet head 1 according to this embodiment, by properly driving active layers in the actuator unit 21, a character, a figure, or the like, having a resolution of 600 dpi can be formed. That is, by selectively driving active layers corresponding to the twelve pressure chamber rows in order in accordance with the transfer of a print medium, a specific character or figure can be printed on the print medium.

By way of example, a case will be described wherein a straight line extending in the first arrangement direction is printed at a resolution of 600 dpi. First, a case will be briefly described wherein nozzles communicate with the same-side acute portions of pressure chambers 10. In this case, in accordance with transfer of a print medium, ink ejection starts from a nozzle in the lowermost pressure chamber row in FIG. 8. Ink ejection is then shifted upward with the selecting of a nozzle belonging to the upper neighboring pressure chamber row. Ink dots are thereby formed, in order, in the first arrangement direction with nozzles neighboring each other at 600 dpi. Finally, all the ink dots form a straight line extending in the first arrangement direction at a resolution of 600 dpi.

On the other hand, in this embodiment, ink ejection starts from a nozzle in the lowermost pressure chamber row 11*a* in FIG. 8, and ink ejection is then shifted upward with the selecting of a nozzle communicating with the upper neighboring pressure chamber row, in order, in accordance with transfer of a print medium. In this embodiment, however, since the positional shift of nozzles in the first arrangement direction per pressure chamber row from the lower side to the upper side is not always the same, ink dots formed, in order, in the first arrangement direction in accordance with the transfer of the print medium are not arranged at regular intervals at 600 dpi.

More specifically, as shown in FIG. 8, in accordance with the transfer of the print medium, ink is first ejected through a nozzle (1) communicating with the lowermost pressure chamber row 11*a* in FIG. 8 to form a dot row on the print medium at intervals corresponding to 50 dpi (about 508.0 μm). After this, as the print medium is transferred and the straight line formation position has reached the position of a nozzle (7) communicating with the second lowermost pressure chamber row 11*a*, ink is ejected through the nozzle (7). The second ink dot is thereby formed at a position shifted from the first formed dot position in the first arrangement direction by a distance of six times the interval corresponding to 600 dpi (about 42.3 μm) (about 42.3 μm×6=about 254.0 μm).

Next, as the print medium is further transferred and the straight line formation position has reached the position of a nozzle (2) communicating with the third lowermost pressure chamber row 11*b*, ink is ejected through the nozzle (2). The third ink dot is thereby formed at a position shifted from the first formed dot position in the first arrangement direction by a distance of the interval corresponding to 600 dpi (about 42.3 μm). As the print medium is further transferred and the straight line formation position has reached the position of a nozzle (8) communicating with the fourth lowermost pressure chamber row 11*b*, ink is ejected through the nozzle (8). The fourth ink dot is thereby formed at a position shifted from the first formed dot position in the first arrangement direction by a distance of seven times the interval corresponding to 600 dpi (about 42.3 μm) (about 42.3 μm×7=about 296.3 μm). As the print medium is further transferred and the straight line formation position has reached the position of a nozzle (5) communicating with the fifth lowermost pressure chamber row 11*a*, ink is ejected through the nozzle (5). The fifth ink dot is thereby formed at a position shifted from the first formed dot position in the first arrangement direction by a distance of four times the interval corresponding to 600 dpi (about 42.3 μm) (about 42.3 μm×4=about 169.3 μm).

After this, in the same manner, ink dots are formed with the selecting of nozzles communicating with pressure chambers 10 in order from the lower side to the upper side in FIG. 8. In this case, when the number of a nozzle in FIG. 8 is N, an ink dot is formed at a position shifted from the first formed dot position in the first arrangement direction by a distance corresponding to (magnification n=N−1)×(interval corresponding to 600 dpi). When the twelve nozzles have been finally selected, the gap between the ink dots to be formed by the nozzles (1) in the lowermost pressure chamber rows 11*a* in FIG. 8 at an interval corresponding to 50 dpi (about 508.0 μm) is filled up with eleven dots formed at intervals corresponding to 600 dpi (about 42.3 μm). Therefore, as the whole, a straight line extending in the first arrangement direction can be drawn at a resolution of 600 dpi.

Figure 9:
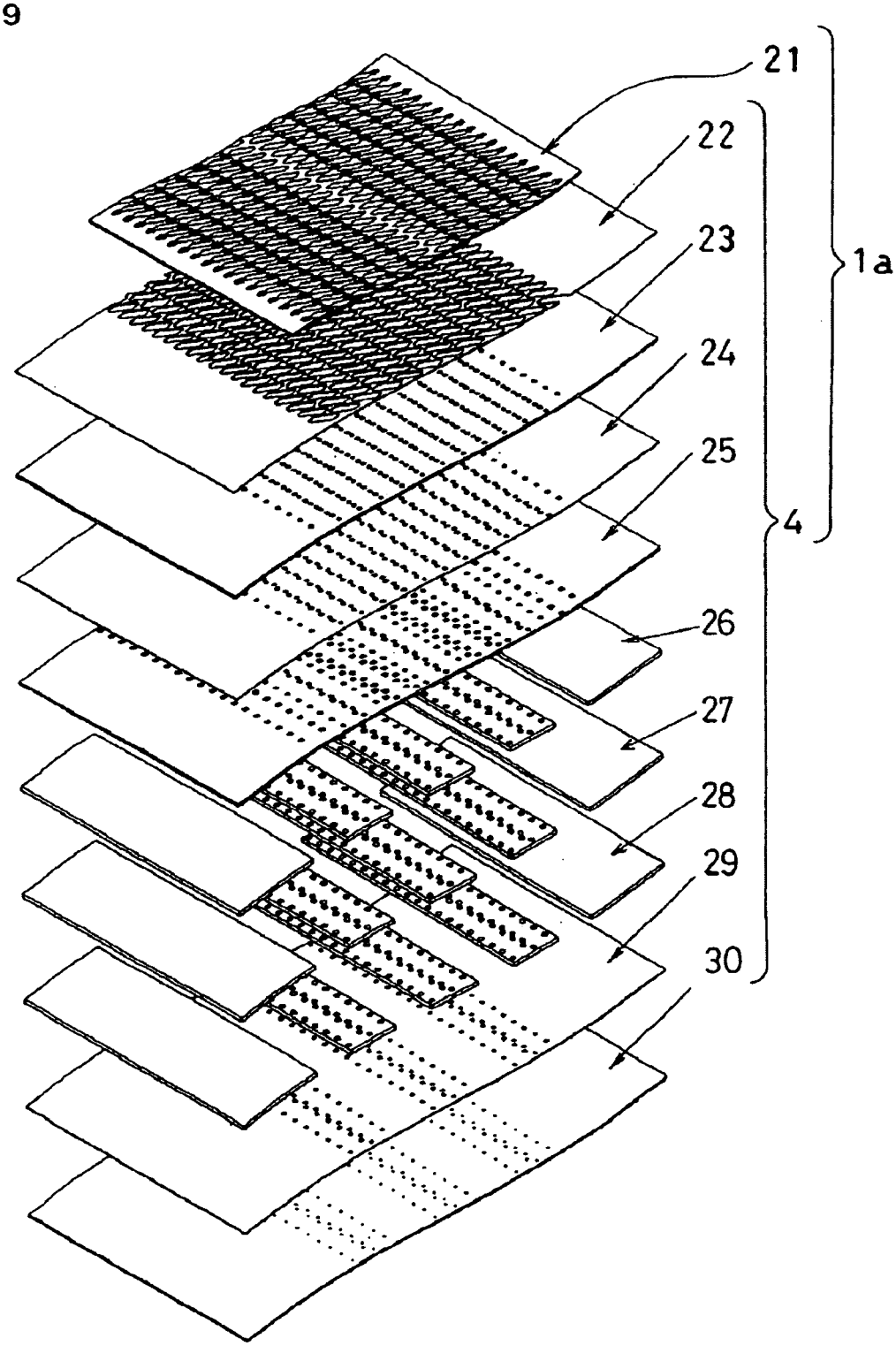
FIG. 9 is a partial exploded perspective view of the head main body of FIG. 4.

FIG. 9 is a partial exploded view of the head main body 1*a* of FIG. 4. Referring to FIGS. 7 and 9, a principal portion on the bottom side of the ink-jet head 1 has a layered structure laminated with ten sheet materials in total, i.e., from the top, an actuator unit 21, a cavity plate 22, a base plate 23, an aperture plate 24, a supply plate 25, manifold plates 26, 27, and 28, a cover plate 29, and a nozzle plate 30. Of them, nine plates other than the actuator unit 21 constitute the passage unit 4.

As will be described later in detail, the actuator unit 21 is laminated with five piezoelectric sheets and provided with electrodes so that three of them may include layers to be active when an electric field is applied (hereinafter, simply referred to as "layer including active layers") and the remaining two layers may be inactive. The cavity plate 22 is made of metal, in which a large number of substantially rhombic openings are formed corresponding to the respective pressure chambers 10. The base plate 23 is made of metal, in which a communication hole between each pressure chamber 10 of the cavity plate 22 and the corresponding aperture 12, and a communication hole between the pressure chamber 10 and the corresponding ink ejection port 8 are formed. The aperture plate 24 is made of metal, in which, in addition to apertures 12, communication holes are formed for connecting each pressure chamber 10 of the cavity plate 22 with the corresponding ink ejection port 8. The supply plate 25 is made of metal, in which communication holes between each aperture 12 and the corresponding sub-manifold channel 5*a* and communication holes for connecting each pressure chamber 10 of the cavity plate 22 with the corresponding ink ejection port 8 are formed. Each of the manifold plates 26, 27, and 28 is made of metal, which defines an upper portion of each sub-manifold channel 5*a* and in which communication holes are formed for connecting each pressure chamber 10 of the cavity plate 22 with the corresponding ink ejection port 8. The cover plate 29 is made of metal, in which communication holes are formed for connecting each pressure chamber 10 of the cavity plate 22 with the corresponding ink ejection port 8. The nozzle plate 30 is made of metal, in which tapered ink ejection ports 8 each functioning as a nozzle are formed for the respective pressure chambers 10 of the cavity plate 22.

These ten plates 21 to 30 are put in layers and are positioned with respect to each other in order form such an ink passage 32 as illustrated in FIG. 7. The ink passage 32 first extends upward from the sub-manifold channel 5*a*, then extends horizontally in the aperture 12, then further extends upward, then again extends horizontally in the pressure chamber 10, then extends obliquely downward in a certain length to get apart from the aperture 12, and then extends vertically downward toward the ink ejection port 8.

Figure 10:
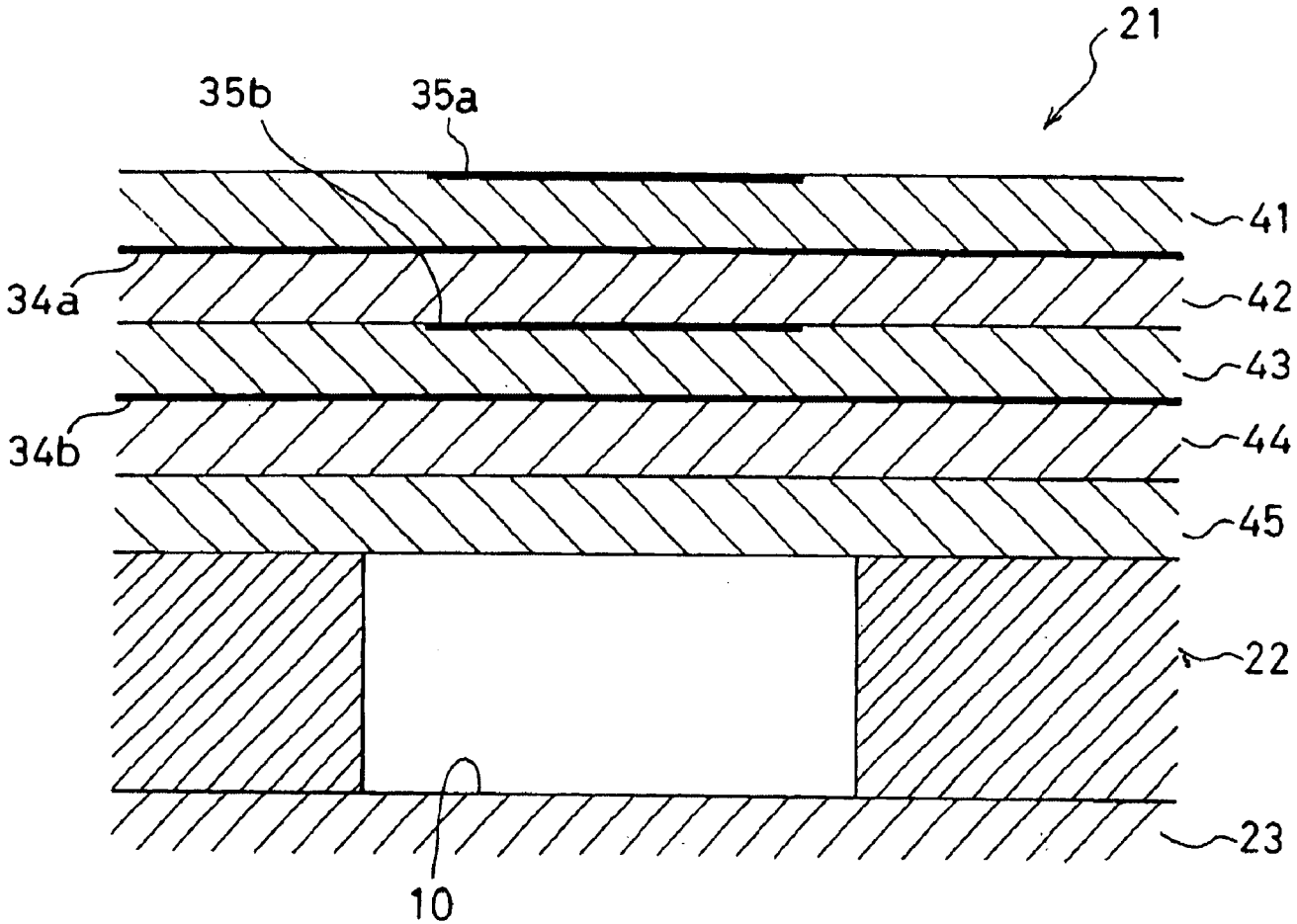
FIG. 10 is a lateral enlarged sectional view of the region enclosed with an alternate long and short dash line in FIG. 7.

Next, the construction of the actuator unit 21 will be described. FIG. 10 is a lateral enlarged sectional view of the region enclosed with an alternate long and short dash line in FIG. 7. Referring to FIG. 10, the actuator unit 21 includes five piezoelectric sheets 41, 42, 43, 44, and 45 having the same thickness of about 15 μm. These piezoelectric sheets 41 to 45 are made into a continuous layered flat plate (continuous flat layers) that is so disposed as to extend over many pressure chambers 10 formed within one ink ejection region in the ink-jet head 1. Since the piezoelectric sheets 41 to 45 are disposed so as to extend over many pressure chambers 10 as the continuous flat layers, the individual electrodes 35*a* and 35*b* can be arranged at a high density by using, e.g., a screen printing technique. Therefore, also the pressure chambers 10 formed at positions corresponding to the individual electrodes 35*a* and 35*b* can be arranged at a high density. This makes it possible to print a high-resolution image. In this embodiment, each of the piezoelectric sheets 41 to 45 is made of a lead zirconate titanate (PZT)-base ceramic material having ferroelectricity.

Between the uppermost piezoelectric sheet 41 of the actuator unit 21 and the piezoelectric sheet 42 neighboring downward the piezoelectric sheet 41, an about 2 μm-thick common electrode 34*a* is interposed. The common electrode 34*a* is made of a single conductive sheet extending substantially in the whole region of the actuator unit 21. Also, between the piezoelectric sheet 43 neighboring downward the piezoelectric sheet 42 and the piezoelectric sheet 44 neighboring downward the piezoelectric sheet 43, an about 2 μm-thick common electrode 34*b* is interposed having the same shape as the common electrode 34*a*.

In a modification, many pairs of common electrodes 34*a* and 34*b*, each having a shape larger than that of a pressure chamber 10 so that the projection image of each common electrode projected along the thickness of the common electrode may include the pressure chamber, may be provided for each pressure chamber 10. In another modification, many pairs of common electrodes 34*a* and 34*b*, each having a shape somewhat smaller than that of a pressure chamber 10 so that the projection image of each common electrode projected along the thickness of the common electrode may be included in the pressure chamber, may be provided for each pressure chamber 10. Thus, the common electrode 34*a* or 34*b* may not always be a single conductive sheet formed on the whole of the face of a piezoelectric sheet. In the above modifications, however, all the common electrodes must be electrically connected with one another so that the portion corresponding to any pressure chamber 10 may be at the same potential.

Referring to FIG. 10, an about 1 μm-thick individual electrode 35*a* is formed on the upper face of the piezoelectric sheet 41 at a position corresponding to the pressure chamber 10. The individual electrode 35*a* has a nearly elliptical shape (length: 850 μm, width: 250 μm) in a plan view similar to that of the pressure chamber 10, so that a projection image of the individual electrode 35*a* projected along the thickness of the individual electrode 35*a* is included in the corresponding pressure chamber 10 (see FIG. 6). Between the piezoelectric sheets 42 and 43, an about 2 μm-thick individual electrode 35*b* having the same shape as the individual electrode 35*a* in a plan view is interposed at a position corresponding to the individual electrode 35*a*. No electrode is provided between the piezoelectric sheet 44 and the piezoelectric sheet 45 neighboring downward the piezoelectric sheet 44, and on the lower face of the piezoelectric sheet 45. Each of the electrodes 34*a*, 34*b*, 35*a*, and 35*b* is made of, e.g., an Ag—Pd-base metallic material.

The common electrodes 34*a* and 34*b* are grounded in a not-illustrated region. Thus, the common electrodes 34*a* and 34*b* are kept at the ground potential at a region corresponding to any pressure chamber 10. The individual electrodes 35*a* and 35*b* in each pair corresponding to a pressure chamber 10 are connected to a driver IC 132 through an FPC 136 including leads independent of another pair of individual electrodes so that the potential of each pair of individual electrodes can be controlled independently of that of another pair(see FIGS. 2 and 3). In this case, the individual electrodes 35*a* and 35*b* in each pair which are vertically arranged may be connected to the driver IC 132 through the same lead.

In the ink-jet head 1 according to this embodiment, the piezoelectric sheets 41 to 43 are polarized in their thickness. Therefore, the individual electrodes 35*a* and 35*b* are set at a potential different from that of the common electrodes 34*a* and 34*b* to apply an electric field in the polarization, the portions of the piezoelectric sheets 41 to 43 to which the electric field has been applied works as active layers and the portions are ready to expand or contract in thickness, i.e., in layers, and to contract or expand perpendicularly to the thickness, i.e., in a plane, by the transversal piezoelectric effect. On the other hand, since the remaining two piezoelectric sheets 44 and 45 are inactive layers having no regions sandwiched by the individual electrodes 35*a* and 35*b* and the common electrodes 34*a* and 34*b*, they can not deform in their selves. That is, the actuator unit 21 has a so-called unimorph structure in which the upper (i.e., distant from the pressure chamber 10) three piezoelectric sheets 41 to 43 are layers including active layers and the lower (i.e., near the pressure chamber 10) two piezoelectric sheets 44 and 45 are inactive layers.

Therefore, when the driver IC 132 is controlled so that an electric field is produced in the same direction as the polarization and the individual electrodes 35*a* and 35*b* are set at a positive or negative predetermined potential relative to the common electrodes 34*a* and 34*b*, active layers in the piezoelectric sheets 41 to 43 sandwiched by the individual electrodes 35*a* and 35*b* and the common electrodes 34*a* and 34*b* contract in a plane, while the piezoelectric sheets 44 and 45 do not contract. At this time, as illustrated in FIG. 10, the lowermost face of the piezoelectric sheets 41 to 45 is fixed to the upper face of partitions partitioning pressure chambers 10 formed in the cavity plate 22, as a result, the piezoelectric sheets 41 to 45 deform into a convex shape toward the pressure chamber side by contracting in a plane by the transversal piezoelectric effect (unimorph deformation). Therefore, the volume of the pressure chamber 10 is decreased to raise the pressure of ink. The ink is thereby ejected through the ink ejection port 8. After this, when the individual electrodes 35*a* and 35*b* are returned to the original potential, the piezoelectric sheets 41 to 45 return to the original flat shape and the pressure chamber 10 also returns to its original volume. Thus, the pressure chamber 10 sucks ink therein through the manifold channel 5.

In another driving method, all the individual electrodes 35*a* and 35*b* are set in advance at a different potential from that of the common electrodes 34*a* and 34*b* so that the piezoelectric sheets 41 to 45 deform into a convex shape toward the pressure chamber 10 side. When an ejecting request is issued, the corresponding pair of individual electrodes 35*a* and 35*b* is set at the same potential as that of the common electrodes 34*a* and 34*b*. After this, at a predetermined timing, the pair of individual electrodes 35*a* and 35*b* is again set at the different potential from that of the common electrodes 34*a* and 34*b*. In this case, at the timing when the pair of individual electrodes 35*a* and 35*b* is set at the same potential as that of the common electrodes 34*a* and 34*b*, the piezoelectric sheets 41 to 45 return to their original shapes. The corresponding pressure chamber 10 is thereby increased in volume from its initial state (the state that the potentials of both electrodes differ from each other), to suck ink from the manifold channel 5 into the pressure chamber 10. After this, at the timing when the pair of individual electrodes 35*a* and 35*b* is again set at the different potential from that of the common electrodes 34*a* and 34*b*, the piezoelectric sheets 41 to 45 deform into a convex shape toward the pressure chamber 10. The volume of the pressure chamber 10 is thereby decreased and the pressure of ink in the pressure chamber 10 increases to eject ink.

In case that the polarization occurs in the reverse direction to the electric field applied to the piezoelectric sheets 41 to 43, the active layers in the piezoelectric sheets 41 to 43 sandwiched by the individual electrodes 35*a* and 35*b* and the common electrodes 34*a* and 34*b* are ready to elongate perpendicularly to the polarization. As a result, the piezoelectric sheets 41 to 45 deform into a concave shape toward the pressure chamber 10 by the transversal piezoelectric effect. Therefore, the volume of the pressure chamber 10 is increased to suck ink from the manifold channel 5. After this, when the individual electrodes 35*a* and 35*b* return to their original potential, the piezoelectric sheets 41 to 45 also return to their original flat shape. The pressure chamber 10 thereby returns to its original volume to eject ink through the ink ejection port 8.

As described above, in the ink-jet head 1 of this embodiment, as shown in FIG. 6, the two-end direction (or the second direction) joining the one end connected with the nozzle and the other end connected with the sub-manifold channel 5*a* of the pressure chamber 10 is substantially parallel with the plane of the passage unit 4 where the pressure chambers 10 are arranged. Therefore, the pressure wave to be generated in the pressure chamber 10 propagates substantially along the plane of the passage unit 4. In case the pressure wave propagates in the direction perpendicular to the plane of the passage unit 4, the AL is shortened so long as the thickness of the head 1 (i.e., the length of the head 1 in the direction perpendicular to the plane) is not increased. In case the pressure wave propagates along the surface of the passage unit 4 as in this embodiment, however, the AL can be relatively long without increasing the thickness of the head 1. This provides a margin in time for matching the timings of generation and reflection of the pressure wave, and thus, the so-called "fill before fire" which is higher in energy efficiency than the "fill after fire" can be performed.

The "fill before fire" is a method, in which a voltage is applied in advance to all the individual electrodes 35*a* and 35*b* to reduce the volumes of all pressure chambers 10, in which the voltage on the individual electrodes 35*a* and 35*b* is released only from the pressure chamber 10 for the ink ejecting action to enlarge its volume thereby to generate negative pressure waves, and in which the voltage is applied again to the individual electrodes 35*a* and 35*b* to reduce the volume of the pressure chambers 10 thereby to superpose the positive pressure waves at a timing for the negative pressure waves generated beforehand each after inverted and reflected, so that the ejection pressure is efficiently applied to the ink by using the pressure waves propagating in the pressure chambers 10. In short, according to the aforementioned construction, it is possible to improve the energy efficiency in the ink-jet head 1.

Moreover, the pressure chamber 10 has the elliptical planar shape having no corner bulging in the direction to leave the line joining the one end and the other. Therefore, the spacing between the adjoining pressure chambers 10 can be enlarged to suppress the crosstalk which might otherwise raise a problem in case the pressure chambers 10 are arranged adjacent to each other.

Moreover, the planar shape of the pressure chamber 10 is formed into the elliptical shape having no corner as a whole so that the spacing between the adjoining pressure chambers 10 can be enlarged to suppress the crosstalk which might otherwise cause a problem in case the pressure chambers 10 are arranged close to each other. Moreover, the flow of ink is smoothed, and the discharge of air bubbles in the ink by the purge is made easy so that the bubbles are hard to accumulate in the ink. Therefore, it is possible to eliminate the problem that the normal discharge of ink is obstructed by the bubbles.

Moreover, the direction along the longer diagonal line of the rhombic region 10*x* confining the pressure chamber 10 (i.e., the diagonal direction: the first direction) and the direction joining the one end and the other end of the pressure chamber 10 (i.e., the two-end direction: the second direction) are coincident in order to achieve the high integration of the pressure chambers 10 and the smooth flow of ink and to enlarge the AL effectively. As the AL is the larger, moreover, it is the easier to control the "fill before fire".

Moreover, the effect to enlarge the AL can also be obtained because the planar shape of the pressure chamber 10 on the surface of the passage unit 4 is slender along the direction joining the one end and the other (i.e., the two-end direction: the second direction) or the propagation direction of the pressure waves.

Moreover, the planar shape of the pressure chamber 10 is symmetrical with respect to the axis in the propagation direction of the pressure wave or the direction joining the end and the other (i.e., the two-end direction: the second direction). Therefore, the pressure waves to be generated in the pressure chamber 10 are symmetrically reflected to provide an effect that the discharge of ink is stabilized.

Further, since the passage unit 4 is formed with nine sheet members 22 to 30 laminated with each other and each sheet having corresponding openings, the manufacture of the passage unit 4 is easy.

Further, in the head main body 1*a* of the ink-jet head 1, separate actuator units 21 corresponding to the respective ink ejection regions are bonded onto the passage unit 4 to be arranged along the length of the passage unit 4. Therefore, each of the actuator units 21 apt to be uneven in dimensional accuracy because they are formed by sintering or the like, can be positioned to the passage unit 4 independently from another actuator unit 21. Thus, even in the case of a long head, the increase in shift of each actuator unit 21 from the accurate position on the passage unit 4 is restricted, and both can accurately be positioned with respect to each other. Therefore, as to the individual electrodes 35*a* and 35*b* which are relatively apart from a mark, the individual electrodes 35*a* and 35*b* can not considerably be shifted from the predetermined position to the corresponding pressure chamber 10. As a result, good ink ejection performance can be obtained and the manufacture yield of the ink-jet heads 1 is remarkably improved.

On the other hand, contrary to the above, if a long-shaped actuator unit 4 is made like the passage unit 21, the more the individual electrodes 35*a* and 35*b* are apart from the mark, the larger the shift of the individual electrodes 35*a* and 35*b* is from the predetermined position on the corresponding pressure chamber 10 in a plan view when the actuator unit 21 is laid over the passage unit 4. As a result, the ink ejection performance of a pressure chamber 10 which are relatively apart from the mark is deteriorated and thus the uniformity of the ink ejection performance in the ink-jet head 1 is not obtained.

Further, in the actuator unit 21, since the piezoelectric sheets 41 to 43 are sandwiched by the common electrodes 34*a* and 34*b* and the individual electrodes 35*a* and 35*b*, the volume of each pressure chamber 10 can easily be changed by the piezoelectric effect. Besides, since the piezoelectric sheets 41 to 45 are made into a continuous layered flat plate (continuous flat layers), the actuator unit 21 can easily be manufactured.

Further, the ink-jet head 1 has actuator units 21 each having a unimorph structure in which the piezoelectric sheets 44 and 45 near each pressure chamber 10 are inactive and the piezoelectric sheets 41 to 43 distant from each pressure chamber 10 include active layers. Therefore, the change in volume of each pressure chamber 10 can be increased by the transversal piezoelectric effect. As a result, in comparison with an ink-jet head in which a layer, including active portions, is provided on the pressure chamber 10 side and a non-active layer is provided on the opposite side, lowering the voltage to be applied to the individual electrodes 35*a* and 35*b* and/or high integration of the pressure chambers 10 can be intended. By lowering the voltage to be applied, the driver, for driving the individual electrodes 35*a* and 35*b*, can be made small in size and the cost can be held down. In addition, each pressure chamber 10 can be made small in size. Besides, even in case of a high integration of the pressure chambers 10, a sufficient amount of ink can be ejected. Thus, a decrease in size of the head 1 and a highly dense arrangement of printing dots can be realized.

Further, in the head main body 1*a* of the ink-jet head 1, each actuator unit 21 has a substantially trapezoidal shape. The actuator units 21 are arranged in two lines in a staggered shape so that the parallel opposed sides of each actuator unit 21 extend along the length of the passage unit 4, and the oblique sides of each neighboring actuator units 21 overlap each other in the width of the passage unit 4. Since the oblique sides of each neighboring actuator units 21 thus overlap each other, in the length of the ink-jet head 1, the pressure chambers 10 existing along the width of the passage unit 4 can compensate each other. As a result, when realizing high-resolution printing, a small-size ink-jet head 1 having a very narrow width can be realized.

Here, the planar shape of the pressure chamber on the passage unit 4 may not be slender along the direction joining the one end connected with the nozzle and the other end connected with the sub-manifold channel 5*a* (i.e., the two-end direction: the second direction). In this case, however, it is impossible to expect the high integration of the pressure chambers.

Moreover, the matrix arrangement direction of the pressure chambers on the surface of the passage unit 4 may not be limited to the first arrangement direction and the second arrangement direction, as shown in FIG. 6, but may take various directions, as long as it is along the surface of the passage unit 4.

Figure 11A:
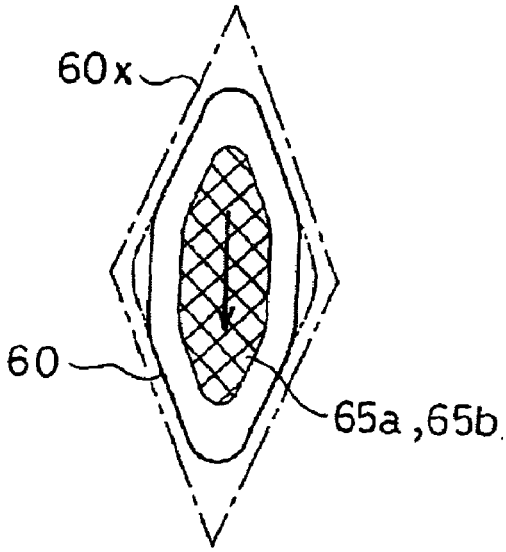
FIG. 11A is a diagram showing a first modification in a planar shape of a pressure chamber.
Figure 11B:
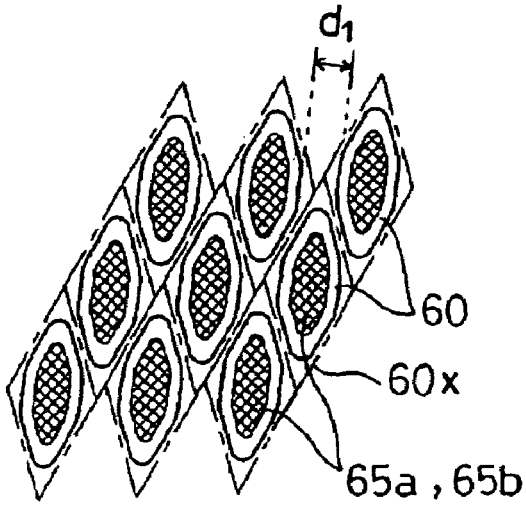
FIG. 11B is a diagram showing the state, in which the pressure chambers illustrated in FIG. 11A are arranged in a 3×3 matrix.
Figure 12A:
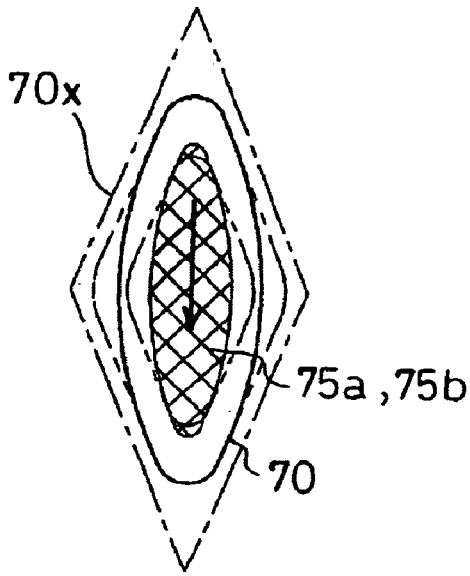
FIG. 12A is a diagram showing a second modification in the planar shape of a pressure chamber.

Moreover, the region for confining the pressure chamber 10 may be a parallelogram but may not be limited to the rhombic shape. The planar shape of the pressure chamber 10 itself contained in that region may be suitably changed in various shapes, as long as it is confined in that region and it is an elliptical shape or a 2n-angled shape (n: a natural number, $n \geqq 3$) having no corner bulging in the direction to leave the line joining the one end and the other end. For example, a modification of the planar shape of the pressure chamber is shown in FIG. 11A and FIG. 12A. In FIG. 11A, a first modification is exemplified by a pressure chamber 60 having a substantially hexagonal planar shape, in which the corners corresponding to the obtuse portions of a rhombic region 60*x* are cut off substantially in parallel to the direction joining the one end and the other of the pressure chamber 10 (i.e., the two-end direction: the second direction). In FIG. 12A, a second modification is exemplified by a pressure chamber 70 having a substantially elliptical planar shape more slender than that of the aforementioned embodiment along the direction joining the one end and the other of the pressure chamber 10 (i.e., the two-end direction: the second direction). Each of individual electrodes 65*a* and 65*b* and individual electrodes 75*a* and 75*b* has respectively a substantially hexagonal shape and a elliptical shape, which is substantially similar to and slightly smaller than the pressure chambers 60 and 70. Here, FIGS. 11A and 11B and FIGS. 12A and 12B show neither a nozzle connected with the one end of the pressure chamber 60 nor a sub-manifold channel connected with the other end of the pressure chamber 60. However, a nozzle and a sub-manifold channel are formed respectively at the two ends on the longer diagonal line of rhombic region 60*x* and 70*x*. Each of the arrows in FIGS. 11A and 11B show the propagation direction of the pressure wave.

Figure 12B:
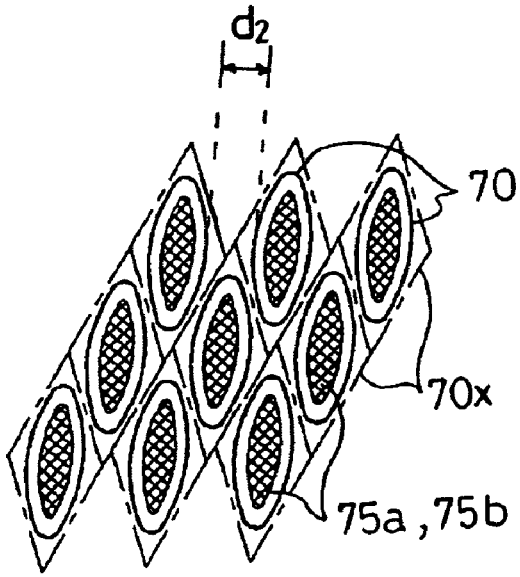
FIG. 12B is a diagram showing the state, in which the pressure chambers illustrated in FIG. 12A are arranged in a 3×3 matrix.

FIG. 11B and FIG. 12B show the states, in which the pressure chambers 60 and 70 according to the first and second modifications illustrated in FIGS. 11A and 12B are arranged in a 3×3 matrix, respectively, when the pressure chambers 60 having a substantially hexagonal plane according to the first modification are arranged in the matrix, as shown in FIG. 11B, the spacing, as taken in the direction parallel to the shorter diagonal line of the rhombic region 60*x*, between the adjoining pressure chambers 60 and 60 is designated by d1. Likewise, the aforementioned spacing in the pressure chambers 70 having the substantially elliptical plane according to the second modification and arranged in the matrix shown in FIG. 12B is designated by d2. It will be understood that the spacing between the adjoining pressure chambers is larger than that of the case in which the individual pressure chambers have shapes similar to and slightly smaller than those of the rhombic regions 60*x* and 70*x*. With this enlarged spacing, such a crosstalk hardly occurs as might otherwise raise a problem in case the pressure chambers are arranged close to each other.

Particularly for the pressure chambers 60 according to the first modification, as shown in FIGS. 11A and 11B, the spacing between the pressure chambers 60 arranged in the matrix can be efficiently enlarged by cutting off the corners substantially in parallel to the direction joining the one end and the other end of the pressure chambers 60 (i.e., the two-end direction: the second direction). In other words, the spacing between the pressure chambers 60 can be enlarged to suppress the crosstalk without drastically reducing the area of the pressure chambers 60. Moreover, the pressure chambers 60 have a relatively simple planar shape such as the substantially hexagonal shape, so that they can be formed relatively easily.

Moreover, the planar shape of the pressure chambers may also be a pentagonal, decagonal or deformed elliptical shape, for example. Further, the passage unit 4 may not be formed with laminated sheet members.

Further, the material of each of the piezoelectric sheets and electrodes is not limited to those described above, and it may be changed to another known material. Each of the inactive layers may be made of an insulating sheet other than a piezoelectric sheet. The number of layers including active layers, the number of inactive layers, etc., may be changed properly. For example, although piezoelectric sheets as layers including active layers included in an actuator unit 21 are put in three or five layers in the above-described embodiment, piezoelectric sheets may be put in seven or more layers. In this case, the numbers of individual and common electrodes may properly be changed in accordance with the number of layered piezoelectric sheets. Although each actuator unit 21 includes two layers of piezoelectric sheets as inactive layers in the above-described embodiment, each actuator unit 21 may include only one inactive layer. Alternatively, each actuator unit 21 may include three or more inactive layers as far as they do not hinder the expansion or contraction deformation of the actuator unit 21. Although each actuator unit 21 of the above-described embodiment includes inactive layers on the pressure chamber side of layers including active layers, a layer or layers including active layers may be disposed on the pressure chamber 10 side of the inactive layers. Alternatively, no inactive layer may be provided. However, by providing the inactive layers 44 and 45 on the pressure chamber 10 side of the layers including active layers, it is expected to further improve the deformation efficiency of the actuator unit 21.

Further, although the common electrodes are kept at the ground potential in the above-described embodiment, this feature is not limitative. The common electrodes may be kept at any potential as far as the potential is common to all pressure chambers 10.

Further, in the above-described embodiment, as illustrated in FIG. 4, trapezoidal actuator units 21 are arranged in two lines in a staggered shape. But, each actuator unit may not always be trapezoidal. Besides, actuator units may be arranged in a single line along the length of the passage unit. Alternatively, actuator units may be arranged in three or more lines in a staggered shape. Further, not one actuator unit 21 is disposed to extend over pressure chambers 10 but one actuator unit 21 may be provided for each pressure chamber 10.

Further, a large number of common electrodes 34*a* and 34*b* may be formed for each pressure chamber 10 so that a projection image of the common electrodes in the thickness of the common electrodes includes a pressure chamber region or the projection image is included within the pressure chamber region. Thus, each of the common electrodes 34*a* and 34*b* may not always be made of a single conductive sheet provided in the substantially whole region of each actuator unit 21. In such a case, however, the parts of each common electrode must be electrically connected with one another so that all the parts corresponding to the respective pressure chambers 10 are at the same potential.

While this invention has been described in conjunction with the specific embodiments outlined above, it is evident that many alternatives, modifications and various will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head having a passage unit including a plurality of pressure chambers each having one end connected with a nozzle and another end connected with an ink supply source, wherein each of said pressure chambers has a substantially 2n-angled planar shape (n: a natural number $n \geqq 3$), which is confined in one of a plurality of parallelogram regions, with no corner bulging in a direction to leave a line joining said one end and said another end thereof, in a plane of said passage unit where said pressure chambers are arranged, and a first direction along a longer diagonal line of said parallelogram region and a second direction joining said one end and said another end in each of said pressure chambers are substantially coincident with each other.

2. The ink-jet head according to claim 1, wherein said planar shape of said pressure chamber is substantially hexagonal.

3. The ink-jet head according to claim 1, wherein the planar shape of said pressure chamber is slender along said second direction.

4. The ink-jet head according to claim 1, wherein the planar shape of said pressure chamber is axially symmetrical with respect to said second direction.

5. The ink-jet head according to claim 1, wherein said pressure chambers are arranged in a matrix in a plane of said passage unit.

6. The ink-jet head according to claim 1, wherein a piezoelectric sheet for changing the volume of each of said pressure chambers is disposed so as to extend over two or more of said pressure chambers.

7. The ink-jet head according to claim 1, further comprising:

an actuator unit arranged so as to extend over said pressure chambers, for changing the volume of each of said pressure chambers.

8. The ink-jet head according to claim 1, wherein said parallelogram regions are arranged adjacent to each other so as to share borders with all other parallelogram regions adjacent thereto.

9. An ink-jet head having a passage unit including a plurality of pressure chambers each having one end connected with a nozzle and another end connected with an ink supply source, wherein each of said pressure chambers has a substantially elliptical planar shape which is confined in one of a plurality of parallelogram regions, said parallelogram regions being arranged adjacent to each other so as to share borders with all other parallelogram regions adjacent thereto, in a plane of said passage unit where said pressure chambers are arranged, and a first direction along a longer diagonal line of said parallelogram region and a second direction joining said one end and said another end in each of said pressure chambers are substantially coincident with each other.

10. The ink-jet head according to claim 9, wherein the planar shape of said pressure chamber is slender along said second direction.

11. The ink-jet head according to claim 9, wherein the planar shape of said pressure chamber is axially symmetrical with respect to said second direction.

12. The ink-jet head according to claim 9, wherein said pressure chambers are arranged in a matrix along the plane of said passage unit.

13. The ink-jet head according to claim 9, wherein a piezoelectric sheet for changing the volume of each of said pressure chambers is disposed so as to extend over two or more of said pressure chambers.

14. The ink-jet head according to claim 9, further comprising:

an actuator unit arranged so as to extend over said pressure chambers for changing the volume of said pressure chambers.

15. An ink-jet printer including an ink-jet head comprising a passage unit having a plurality of pressure chambers each having one end connected with a nozzle and another end connected with an ink supply source, wherein each of said pressure chambers has a substantially 2n-angled planar shape (n: a natural number $n \geqq 3$), which is confined in one of a plurality of parallelogram regions, with no corner bulging in a direction to leave a line joining said one end and said another end thereof, in a plane of said passage unit where said pressure chambers are arranged, and a first direction along a longer diagonal line of said parallelogram region and a second direction joining said one end and said another end in each of said pressure chambers are substantially coincident with each other.

16. The ink-jet printer according to claim 15, wherein said parallelogram regions are arranged adjacent to each other so as to share borders with all other parallelogram regions adjacent thereto.

17. An ink-jet printer including an ink-jet head comprising a passage unit having a plurality of pressure chambers each having one end connected with a nozzle and another end connected with an ink supply source, wherein each of said pressure chambers has a substantially elliptical planar shape which is confined in one of a plurality of parallelogram regions, said parallelogram regions being arranged adjacent to each other so as to share borders with all other parallelogram regions adjacent thereto, in a plane of said passage unit where said pressure chambers are arranged, and a first direction along a longer diagonal line of said parallelogram region and a second direction joining said one end and said another end in each of said pressure chambers are substantially coincident with each other.

18. An ink-jet head comprising a passage unit including a plurality of pressure chambers each having one end connected with a nozzle and another end connected with an ink supply source, the plurality of pressure chambers being arranged in a matrix in a plane, wherein a direction joining said one end and said another end in each of said pressure chambers is substantially in parallel with a plane of said passage unit where said pressure chambers are arranged.

19. The ink-jet head according to claim 18, wherein each of said pressure chambers has a planar shape which is confined in one of a plurality of parallelogram regions, said parallelogram regions being arranged adjacent to each other in a matrix in a first direction corresponding to a longitudinal direction of said passage unit and in a second direction different from said first direction, in a plane of said passage unit where said pressure chambers are arranged, and a third direction along a longer diagonal line of said parallelogram region and a fourth direction joining said one end and said other end in each of said pressure chambers are substantially parallel to each other.

20. The ink-jet head according to claim 19, wherein said third direction and said fourth direction are coincident with each other.

21. The ink-jet head according to claim 19, wherein the planar shape of said pressure chambers, in a plane of said passage unit where said pressure chambers are arranged, is slender along said fourth direction.

22. The ink-jet head according to claim 19, wherein the planar shape of said pressure chambers, in a plane of said passage unit where said pressure chambers are arranged, is axially symmetrical with respect to said fourth direction.

23. The ink-jet head according to claim 19, wherein the planar shape of said pressure chambers, in a plane of said passage unit where said pressure chambers are arranged, is a parallelogram substantially similar to said parallelogram region.

24. The ink-jet head according to claim 23, wherein the planar shape of said pressure chambers, in a plane of said passage unit where said pressure chambers are arranged, is rhombic.

25. The ink-jet head according to claim 19, wherein said parallelogram regions are arranged adjacent to each other so as to share borders with all other parallelogram regions adjacent thereto.

26. The ink-jet head according to claim 18, wherein a piezoelectric sheet for changing the volume of each of said pressure chambers is disposed so as to extend over two or more of said pressure chambers.

27. An ink-jet head comprising a passage unit including a plurality of pressure chambers each having one end connected with a nozzle and another end connected with an ink supply source, the plurality of pressure chambers being arranged in a matrix in a plane, wherein a direction joining said one end and said another end in each of said pressure chambers is substantially in parallel with a plane of said passage unit where said pressure chambers are arranged, each of said pressure chambers having a planar shape which is confined in one of a plurality of parallelogram regions, said parallelogram regions being arranged adjacent to each other in a matrix in a first direction corresponding to a longitudinal direction of said passage unit and in a second direction different from said first direction, in a plane of said passage unit where said pressure chambers are arranged, a third direction along a longer diagonal line of said parallelogram region and a fourth direction joining said one end and said another end in each of said pressure chambers being coincident with each other, and a piezoelectric sheet for changing the volume of each of said pressure chambers being disposed so as to extend over two or more of said pressure chambers.

28. An ink-jet printer including an ink-jet head comprising a passage unit having a plurality of pressure chambers each having one end connected with a nozzle and another end connected with an ink supply source, the plurality of pressure chambers being arranged in a matrix in a plane, wherein a direction joining said one end and said another end in each of said pressure chambers is in parallel with a plane of said passage unit where said pressure chambers are arranged.

29. An ink-jet head having a passage unit including a plurality of pressure chambers each having one end connected with a nozzle and another end connected with an ink supply source, wherein each of said pressure chambers has a substantially 2n-angled planar shape (n: a natural number, $n \geqq 3$), which is confined in one of a plurality of parallelogram regions, and corners of which do not include said one end and said another end are rounded, in a plane of said passage unit where said pressure chambers are arranged, and a first direction along a longer diagonal line of said parallelogram region and a second direction joining said one end and said another end in each of said pressure chambers are substantially coincident with each other.

30. The ink-jet head according to claim 29, wherein said parallelogram regions are arranged adjacent to each other so as to share borders with all other parallelogram regions adjacent thereto.

* * * * *